US006504701B1

(12) United States Patent
Takamura et al.

(10) Patent No.: US 6,504,701 B1
(45) Date of Patent: Jan. 7, 2003

(54) CAPACITIVE ELEMENT DRIVE DEVICE

(75) Inventors: Jun Takamura, Mishima (JP); Noboru Nitta, Tagata-gun (JP); Shunichi Ono, Tagata-gun (JP); Tadashi Maruyama, Yokohama (JP)

(73) Assignees: Toshiba Tec Kabushiki Kaisha, Tokyo (JP); Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/405,597

(22) Filed: Sep. 27, 1999

(30) Foreign Application Priority Data

Oct. 14, 1998 (JP) ..... 10-292001

(51) Int. Cl.[7] ..... B41J 29/38
(52) U.S. Cl. ..... 361/225; 347/9
(58) Field of Search ..... 347/5, 9, 10, 12, 347/14, 42, 68, 73–80; 361/225–228

(56) References Cited

U.S. PATENT DOCUMENTS 5,764,247 A * 6/1998 Asai ..... 347/10
6,113,209 A * 9/2000 Nitta et al. ..... 347/9

FOREIGN PATENT DOCUMENTS

JP 7-156388 6/1995 ..... B41J/2/045
JP 10-146969 6/1998 ..... B41J/2/045

* cited by examiner

*Primary Examiner*—Ronald W. Leja
(74) *Attorney, Agent, or Firm*—Frishauf, Holtz, Goodman & Chick, P.C.

(57) ABSTRACT

Control signals are input to the gates of a P-MOS transistor and an N-MOS transistor of a CMOS drive circuit from respective control signal generating sections. The CMOS drive circuit drives a piezoelectric member as a capacitive element and the piezoelectric element is used in an ink jet head. A substrate of the P-MOS transistor is provided with a voltage higher than a power supply of the CMOS drive circuit. A first potential difference is supplied between terminals of the piezoelectric element and thereafter, a second potential difference of a polarity opposite to the first potential difference is further supplied between the terminals. A discharge operation is inserted in a time period from the time when supply of the first potential difference is completed till the supply of the second difference gets started. The discharge operating time period is set to a proper value at which a desired operating speed, high reliability and low power consumption are achieved.

18 Claims, 15 Drawing Sheets t1
t3
t4
(B)
t7
(A)
(C)
(D)
Td
t2
t5
t6
P2
N2
P3
N3
P4
N4
ON
OFF
Tp
WAVEFORMS OF GATE VOLTAGES OF MOS TRANSISTORS

INDUCTION BY D2, D4
Vov2
VDD
VSS
INDUCTION BY D2, D4
OUTPUT BY WAVEFORM OF TERMINAL D3

INDUCTION BY D3
Vov1
VDD
INDUCTION BY D3
VSS
OUTPUT BY WAVEFORM OF TERMINALS D2, D4

+VDD
2VDD
0
-VDD
REVERSE CHARGE
DISCHARGE +CHARGE
REVERSE CHARGE
INTRA-TERMINAL DRIVE WAVEFORM OF PIEZOELECTRIC MEMBER
INK EJECTION

Td
P2
N2
P3
N3
P4
N4
ON
OFF
WAVEFORMS OF GATE VOLTAGES OF MOS TRANSISTORS

VDD
VSS
Vov2
INDUCTION BY D2,D4
INDUCTION BY D2,D4
OUTPUT WAVEFORM OF TERMINAL D3

Vov1
INDUCTION BY D3
INDUCTION BY D3
OUTPUT WAVEFORM OF TERMINALS D2, D4

+VDD
0
-VDD
2VDD
INTRA-TERMINAL DRIVE WAVEFORM OF PIEZOELECTRIC MEMBER
INK EJECTION

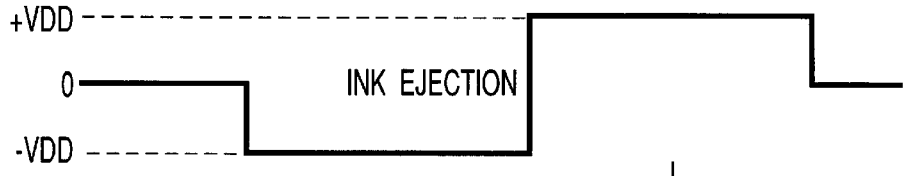
FIG. 9A
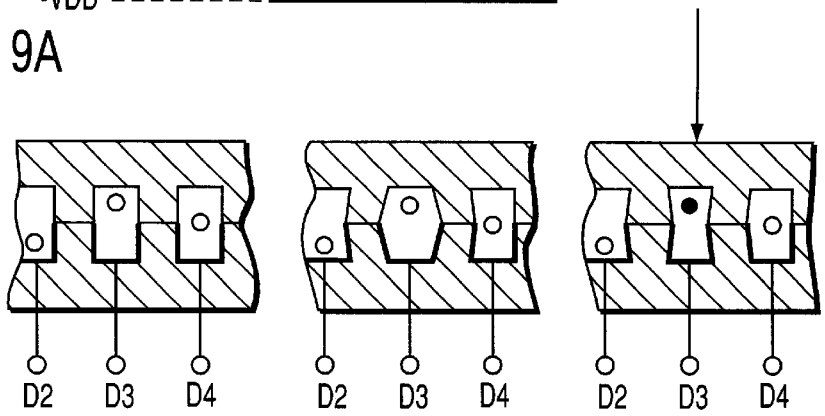
FIG. 9B
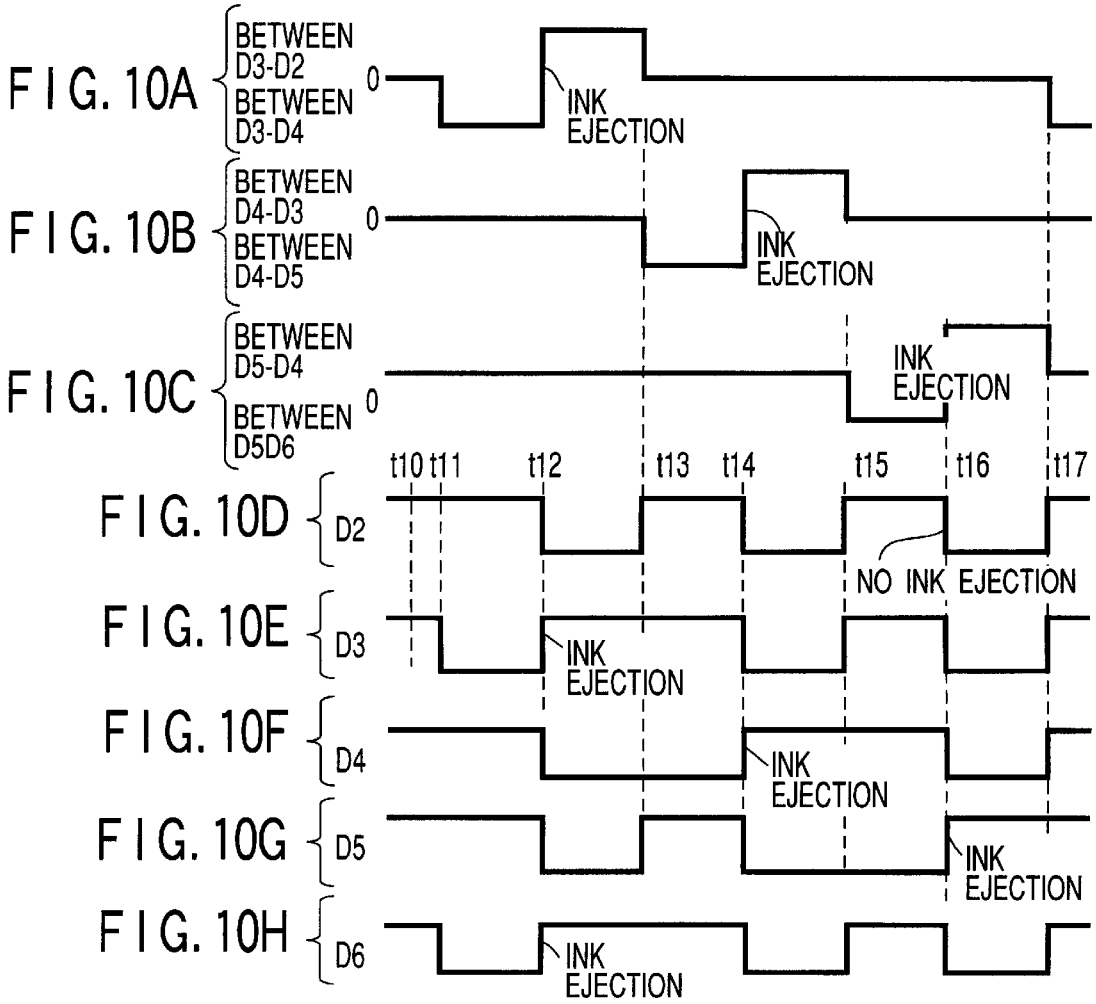

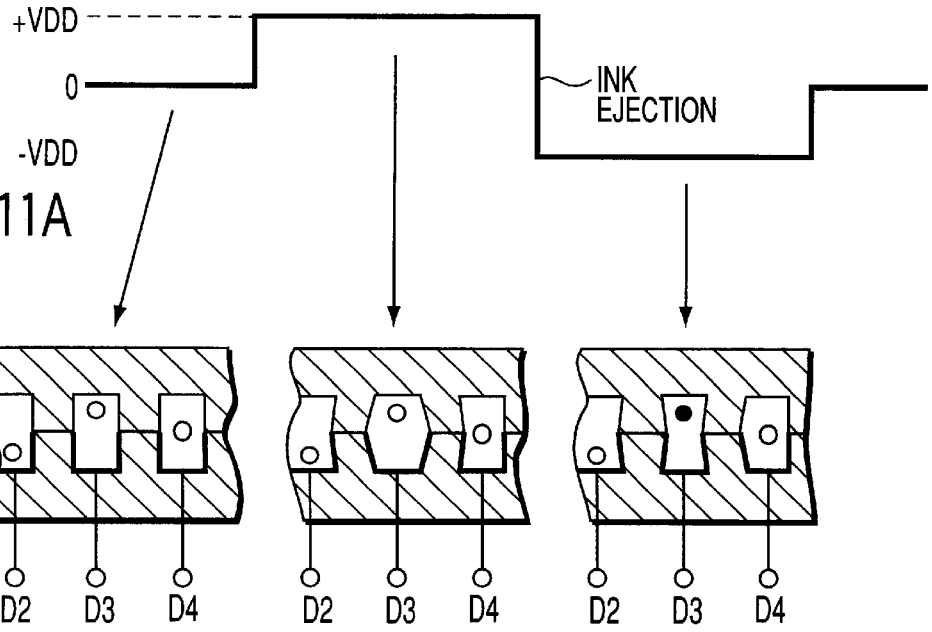
FIG. 11A
FIG. 11B
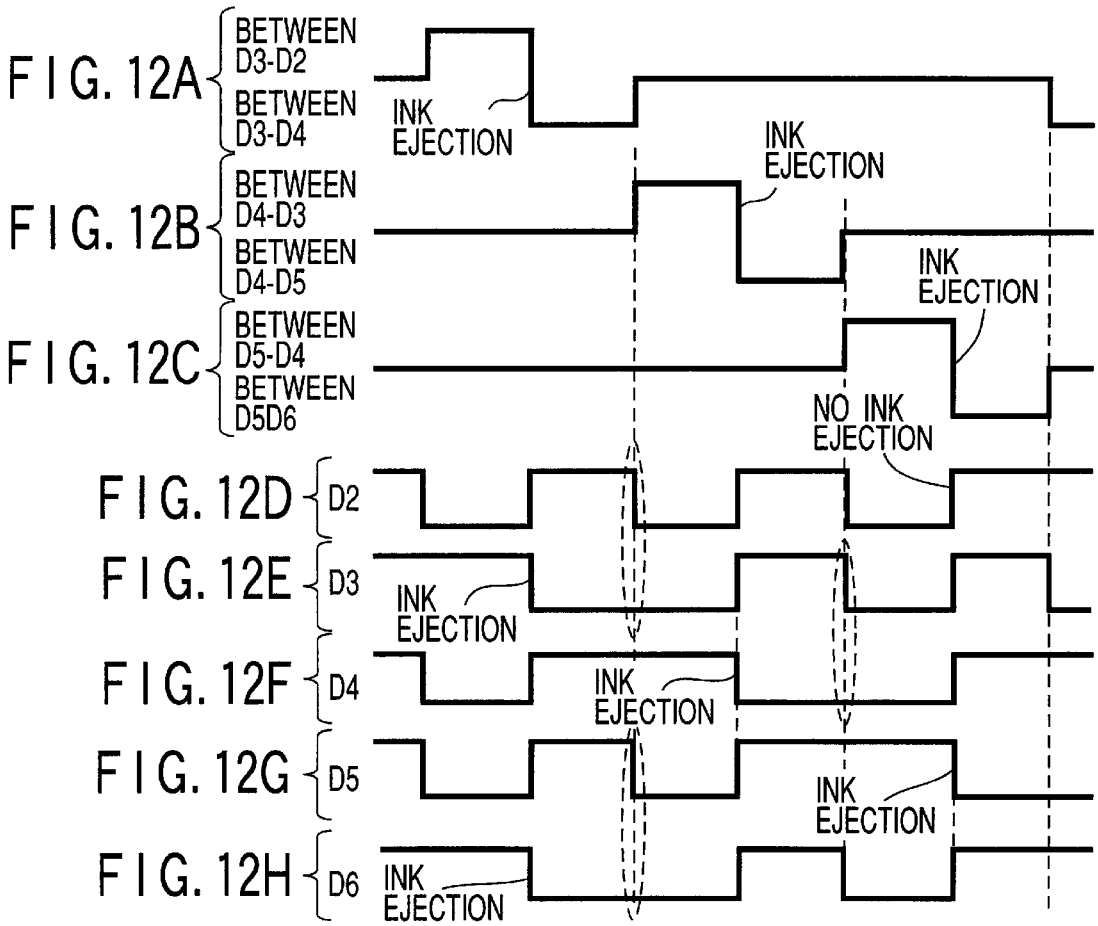

WAVEFORMS OF GATE VOLTAGES OF MOS TRANSISTORS

OUTPUT BY WAVEFORM OF TERMINAL D1

OUTPUT BY WAVEFORM OF TERMINAL D2

INTRA-TERMINAL DRIVE WAVEFORM OF PIEZOELECTRIC MEMBER

WAVEFORM OF PRESSURE IN INK CHAMBER

COMMON ELECTRODE VOLTAGE
V0

SEGMENT ELECTRODE VOLTAGE
V0

INTRA-ELECTRODE APPLIED VOLTAGE
V0
V0
LIQUID CRYSTAL DISPLAY

VOLTAGE WAVEFORM OF COMMON OUTPUT TERMINAL
T

VOLTAGE WAVEFORM OF SEGMENT OUTPUT TERMINAL
VUP

WAVEFORM OF INTRA-TERMINAL DRIVE OF LIQUID CRYSTAL MEMBER
RESPONSE TIME

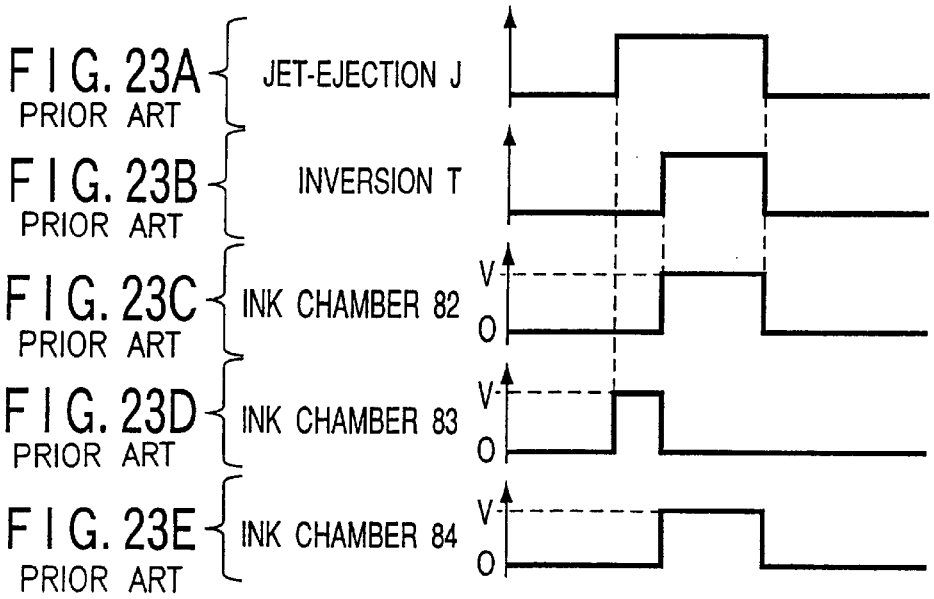
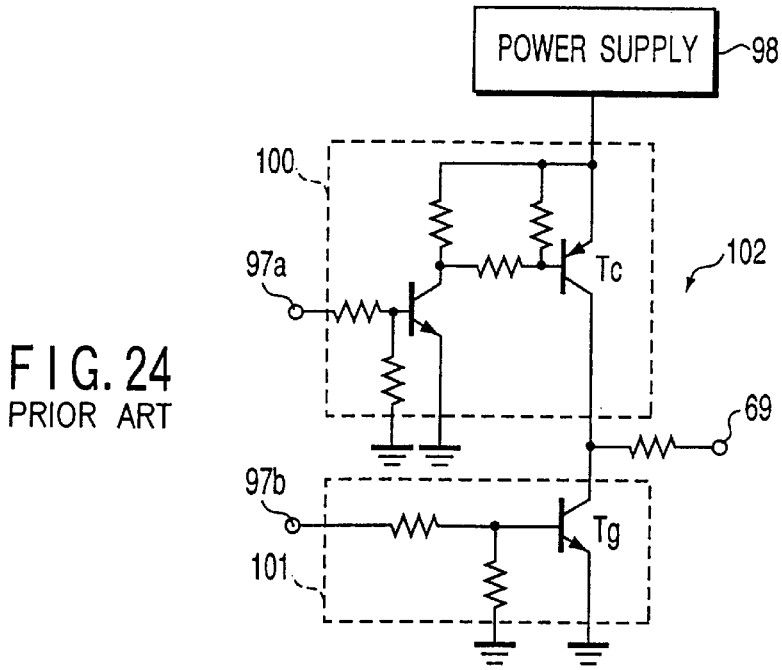
FIG. 24
PRIOR ART
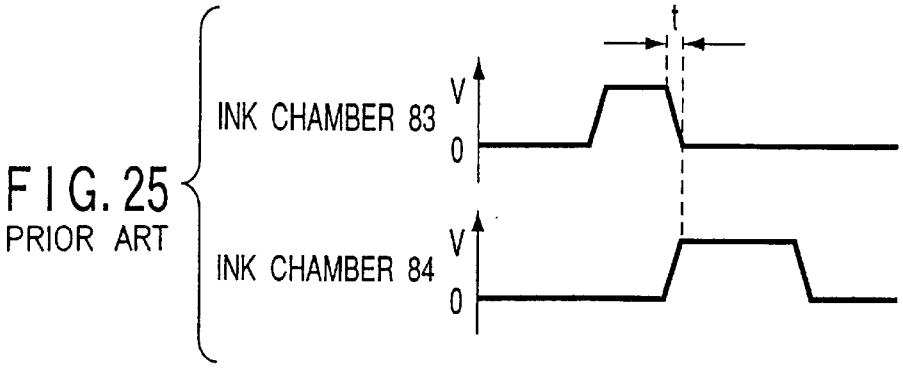
FIG. 25
PRIOR ART

CAPACITIVE ELEMENT DRIVE DEVICE

BACKGROUND OF THE INVENTION

The present invention relates to a capacitive element drive device for driving a capacitive element such as a piezoelectric member and a liquid crystal member.

A drive device for driving an ink-jet head is an example of a capacitive element drive device of this kind. FIG. 20 shows a structure of an ink-jet head 3 in a share-mode. The ink-jet head 3 comprises a plurality of ink chambers 81, 82, . . . constructed of piezoelectric members and electrodes 91, 92, . . . provided to inside walls of the respective ink chambers. The ink chambers 81 . . . are partitioned by the respective piezoelectric members 111, 112, . . .

A conventional head drive device 4 for driving such an ink-jet head 3 is shown in FIG. 21. The head drive device 4 comprises a serial/parallel converter 75, AND gates 76, EX-OR gates 77 and drive circuits 78. Output terminals 79, 80, . . . of the drive circuits 78 are connected to the respective electrodes 91, 92, . . . of the ink chambers.

The drive circuit 78, as shown in FIG. 22, comprises an input terminal 97, an output terminal 89, a power supply 98, resistors R1 to R5 and bipolar transistors Tr1 to Tr4. In this drive circuit 78, when a signal input to the input terminal 97 assumes "1", the bipolar transistor Tr1 is turned on and a power supply voltage is applied to the output terminal 89, while when the signal input assumes "0", the bipolar transistor Tr2 is turned on and the output terminal 89 assumes the ground voltage (0V).

The serial/parallel converter 75 of FIG. 21 is sequentially input with serial print data signals P at cycles of a clock signal C and converts the serial print data signals P into parallel data. When the converter 75 stores print data of one line, the serial/parallel converter 75 latches parallel output in response to a latch signal R.

When a jet signal J as shown in FIG. 23A is input, an electrode potential of a particular ink chamber is raised as shown 23 D and a piezoelectric member constituting a partition wall is applied with the power supply voltage V. At this time, the particular ink chamber is expanded to increase its inside volume. Then when inversion signal T as shown in FIG. 23B is input, an electrode potential of an ink chamber adjacent to the particular ink chamber is raised as shown in FIGS. 23C and 23E and a voltage −V of a polarity opposite from the power supply voltage V is applied to the piezoelectric member of the partition wall. That is, the applied voltage of the partition wall is changed from +V to −V, which results in a change of 2V in applied voltage. On this change, the particular ink chamber is rapidly contracted to reduce the inside volume, which causes an ink in the ink chamber to be ejected.

FIG. 24 shows another example of the drive circuit. The drive circuit 102 comprises a jet voltage generating circuit 100 with an input terminal 97*a* and a discharge circuit 101 with an input terminal 97*b*. When only the input terminal 97*a* is input with an input signal "1", the power supply voltage is applied to the output terminal 69 from the power supply 98 while when only the input terminal 97*b* is input with an input signal "1", the output terminal 69 goes to the ground voltage (0 V).

FIG. 23 is a logical timing chart in which rounding of a signal in rise time and fall time due to a circuit characteristic is omitted and there is a delay in an actual output of a driver circuit. Therefore, actually, there is existent a time period t from when a voltage driving the ink chamber 83 starts decreasing as shown in FIG. 25 until an increase in a voltage for driving peripheral ink chambers 82 and 84 is leveled high.

Generally in order to reduce power consumption or other purposes, MOS (Metal Oxide Semiconductor) transistors are substituted for bipolar transistors. In the drive circuit as shown in FIG. 22 or 24 as well, it is considered that MOS transistors are used instead of bipolar transistors.

However, in a case where a drive circuit is constructed with setting that a substrate potential of a P-MOS transistor is a power supply voltage (VDD) and a substrate potential of an N-MOS transistor is the ground voltage (VSS), a problem as described below is conceived.

When ink is ejected out from an ink jet orifice by applying a voltage to the electrode of each ink chamber as shown in FIG. 23, there is a need that an intra-terminal applied voltage of a piezoelectric member is rapidly changed from +VDD to −VDD opposite from +VDD. That is, it is necessary to shorten a time period, as much as possible, from when a voltage given to the electrode of an ink chamber to be driven starts decreasing until an increase in a voltage given to the electrode of a peripheral ink chamber is leveled off (see FIG. 25).

However, if the time period t is too short, the drain of a P-MOS transistor connected to an electrode of a piezoelectric element, that is a capacitive element, has a risk to assume a higher voltage than the power supply voltage (VDD), or the drain of an N-MOS transistor assumes a lower voltage than the ground voltage (VSS). This is because of delays of rise-up/fall-down in output voltage due to a characteristic of a drive circuit element, and the occurrence of induction and the like in a capacitive element due to rapid changes in the voltage applied to the electrode of an adjacent ink chamber. Hence, a current flows through a parasitic diode of one of the MOS transistors. The parasitic diodes here are diode regions between a P type semiconductor and an N type semiconductor both of which reside between the drain and the substrate and between the source and the substrate of a MOS transistor.

As described above, when the drain of a P-MOS transistor assumes a higher voltage than the power supply voltage (VDD), or when the drain of an N-MOS transistor assumes a lower voltage than the ground voltages (VSS), a current flows though the parasitic diode, that is, a current flows through the substrate of a MOS transistor. As a result, a problem arises since the reliability of the drive circuit is deteriorated. Especially, if repetitions of a turn-on/turn-off of a MOS transistor are affected as in the case where an ink jet head is driven, a current repeatedly flows through the substrate of a MOS transistor, which greatly degrades reliability of a drive circuit.

There has been no idea that a time period from when a decrease in an electrode voltage of an ink chamber constructed of a piezoelectric member gets started until an increase in electrode voltage of an adjacent ink chamber is level off is adjusted.

Therefore, in the above described drive device, the substitution of MOS transistors for bipolar transistors cannot provide a high reliability device.

BRIEF SUMMARY OF THE INVENTION

The present invention provides a capacitive element drive device low in power consumption and high in reliability at a lower cost.

A capacitive element drive device of the present invention is directed to a capacitive element drive device for driving a capacitive element by supplying a first potential difference between terminals of the capacitive element and thereafter, supplying a second potential difference of a polarity opposite from the first potential difference, wherein one of a discharge operation and charge operation of the capacitive element can be set in a time period from when supply of the first potential difference gets started till supply of the second potential difference gets started and the time period is less than a time period in which one of the discharge operation and the charge operation is substantially completed and more than a predetermined time interval.

A capacitive element drive device of the present invention includes a plurality of drive circuits for driving the terminals of the capacitive element, each of the drive circuits comprises an output terminal connected to a terminal of the capacitive element;

a first switching element having a first current terminal to which a first power supply voltage is supplied, a second current terminal connected to the output terminal and a control terminal to which a first control signal is input, a substrate of the first switching element being supplied with a second power supply voltage; and a second switching element having a first current terminal connected to the output terminal, a second current terminal grounded and a control terminal to which a second control signal is input, a substrate of the second switching element being supplied with a ground potential.

The predetermined time interval is set to a time interval at which a potential of a terminal of the capacitive element to be driven is not reduced to lower than the ground potential by induction when the second potential difference is supplied after the discharge operation. The first switching element is a P-MOS transistor and the second switching element is an N-MOS transistor.

According to the present invention, a MOS transistor can be used as a switching element in a capacitive element drive circuit and the capacitive element drive device is low in power consumption, high in reliability and provided at a lower cost. In a discharge operation, no current flows to the ground potential from the power supply and thereby power consumption can be decreased.

The capacitive element has a piezoelectric member, the capacitive load is an ink jet head from which ink is ejected by a piezoelectric distortion effect of the piezoelectric member and the discharge operating time period is set equal to or less than ¼ times as long as a dominant acoustic resonance frequency of the ink chamber, whereby the ink can more vigorously ejected out.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 9A to 9B are a graph and sectional views showing directions of polarization of piezoelectric members.

FIGS. 10A to 10H are graphs showing changes in intra-terminal voltages and terminal voltages in a drive circuit that drives the ink-jet head shown in FIGS. 9A and 9B.

FIGS. 11A and 11B are a graph showing a change in an intra-terminal voltage of a piezoelectric member when the piezoelectric member is provided so as to have polarization in an opposite direction from the ink-jet head shown in FIGS. 9A and 9B and sectional views illustrating operating conditions of ink chambers at voltage levels.

FIGS. 12A to 12H are graphs showing changes in intra-terminal voltages and terminal voltages in the drive circuit that drives the ink-jet head shown in FIGS. 11A and 11B.

FIGS. 23A to 23E are timing charts showing operations of the drive circuit shown in FIG. 21.

FIG. 24 is a circuit diagram showing a configuration of another example of part of the drive circuit shown in FIG. 21.

FIG. 25 is a timing chart showing waveforms of actual terminal voltages observed when a drive circuit is operated according to FIG. 23.

DETAILED DESCRIPTION OF THE INVENTION

Below, description will be made of the first embodiment of a capacitive element drive device according to the present invention that is applied to a drive device for an ink-jet head in a share mode in which piezoelectric members are employed, with reference to FIG. 1 to FIGS. 8A and 8B.

Figure 1:
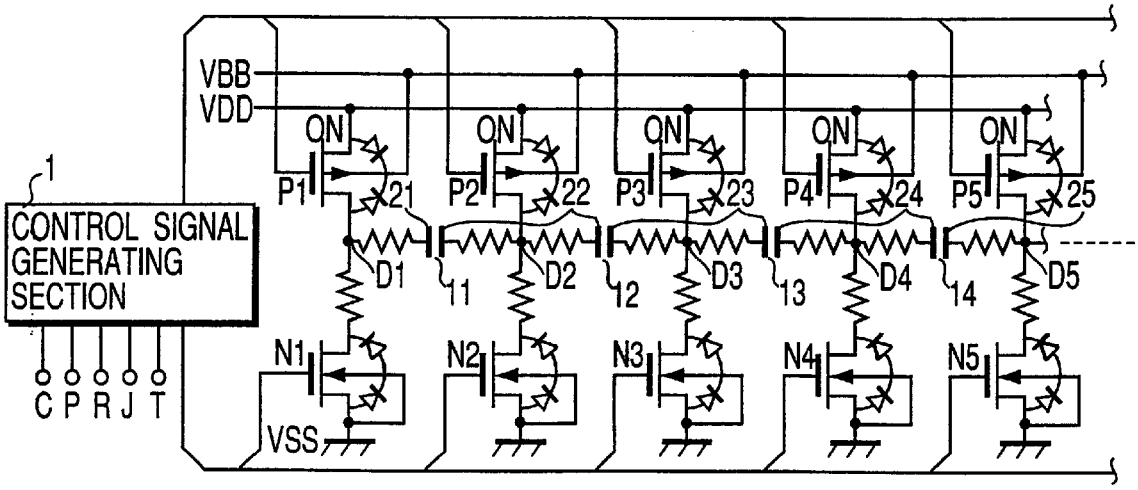
FIG. 1 is a partial circuit diagram showing a configuration of an ink-jet head drive device according to a first embodiment of the present invention.
Figure 2:
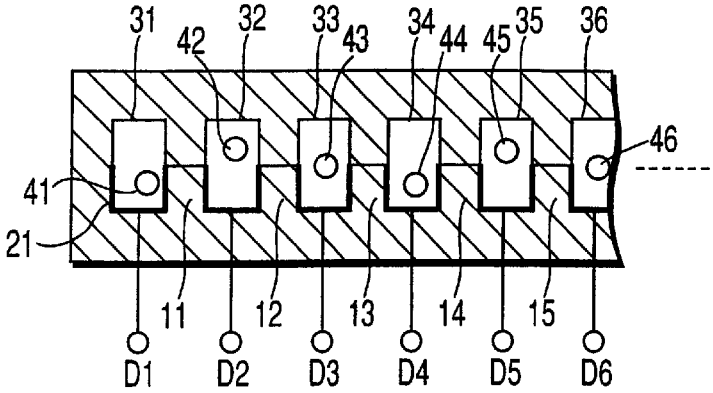
FIG. 2 is a partially sectional view illustrating a structure of an ink-jet head according to the first embodiment.
Figure 3A:
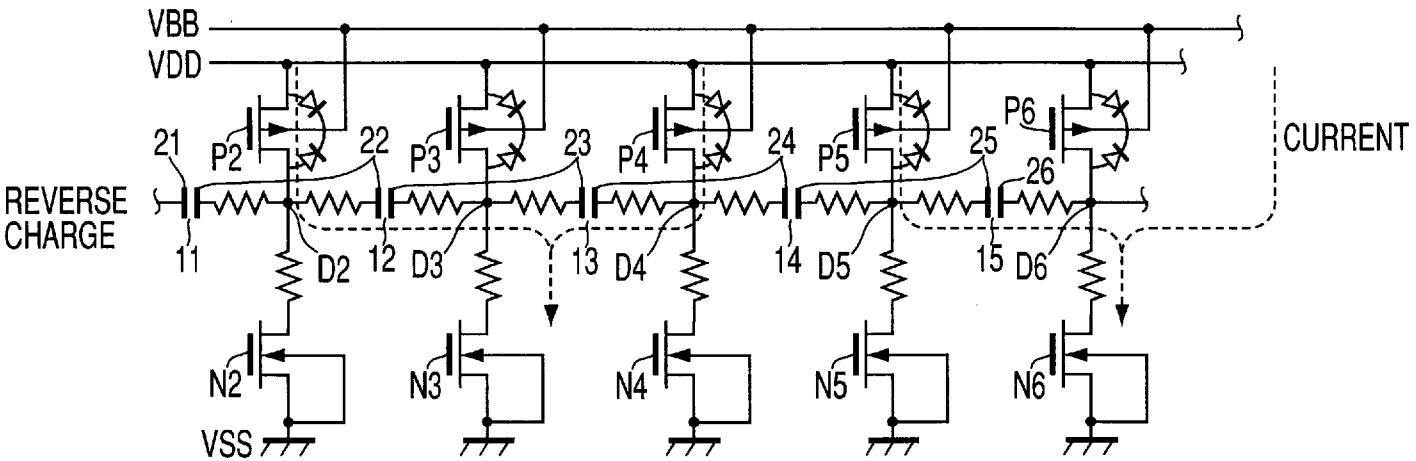
FIGS. 3A to 3D are circuit diagrams by which current flows are shown in states in which an ink-jet head according to the first embodiment in a share mode is driven while being functionally divided in three ways.
Figure 3B:
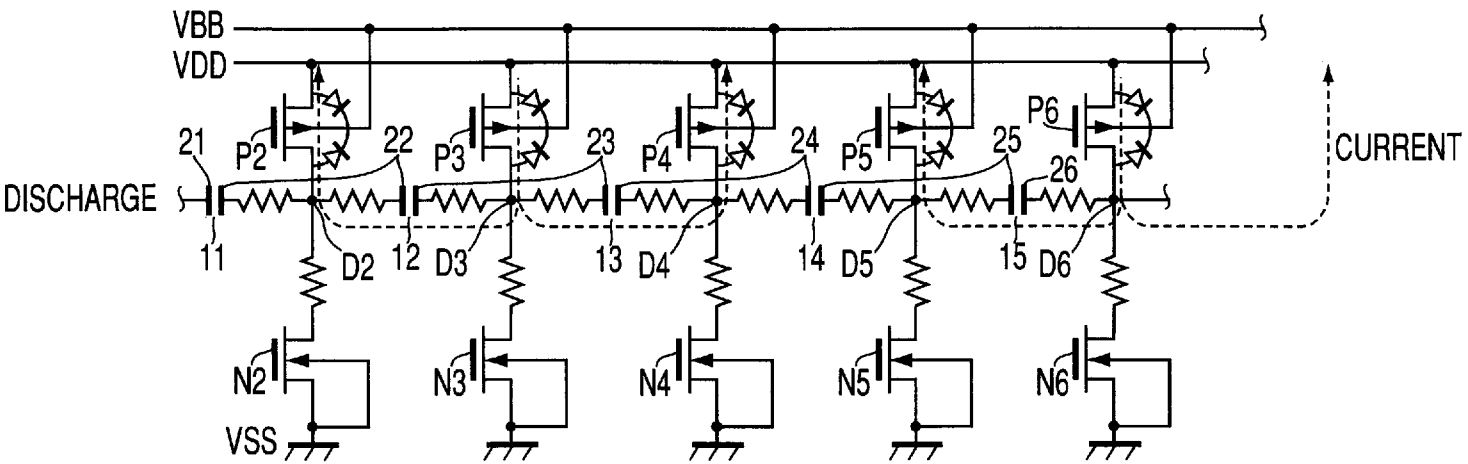
Figure 3C:
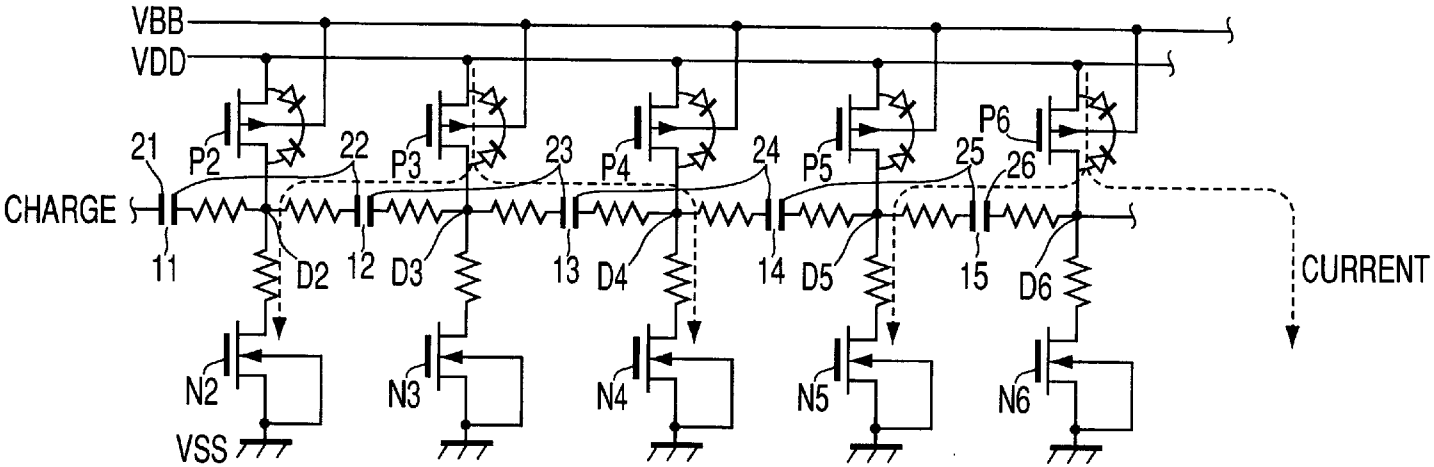
Figure 3D:
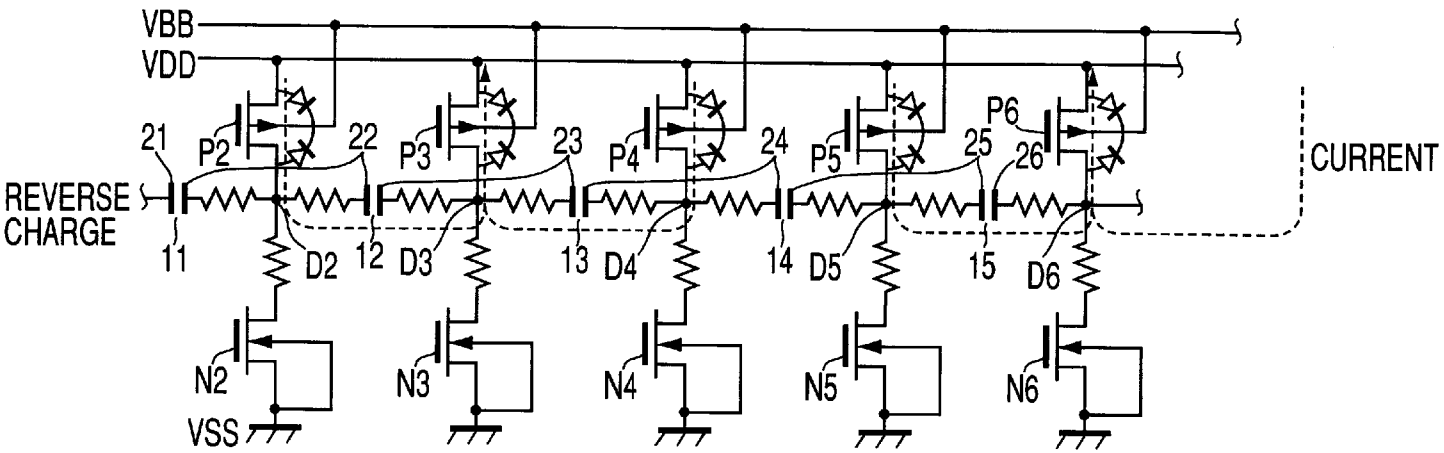

FIG. 1 is a partial circuit diagram showing a configuration of a device according to the first embodiment. FIG. 2 is a partially sectional view showing a structure of an ink-jet head of a share mode. In FIGS. 1 and 2, numerical marks 11, 12, 13, 14, . . . are piezoelectric members constituting walls partitioning a plurality of ink chambers 31, 32, 33, 34, 35, 36 . . . Electrodes are formed on inside wall surfaces of the ink chambers by, for example, electroless nickel plating. That is, an electrode 21 is formed on an inside wall surface of an ink chamber 31, an electrode 22 is formed on an inside wall surface of an ink chamber 32, an electrode 23 is formed on an inside wall surface of an ink chamber 33, . . . further in a similar way, electrodes 24 . . . are formed on inside wall surfaces of respective chambers 34 . . . Ink jet orifices 41, 42, 43, 44, 45 . . . of the respective inks are provided to the chambers 31, 32, 33, 34, 35 . . .

As shown in FIG. 1, the piezoelectric members 11, 12, 13, 14, 15 . . . are respectively connected to terminals D1, D2, D3, D4, D5, D6 . . . (hereinafter referred to as D1 to Dn) by way of internal resistances. The internal resistances means those of nickel platings. P-MOS transistors P1 to Pn that are switching elements are connected between the terminals D1 to Dn and a power supply (VDD) and N-MOS transistors N1 to Nn are connected between the terminals D1 to Dn and the ground voltage (VSS). The P-MOS transistors and the N-MOS transistors constitute CMOS circuits.

A voltage VBB that is higher than the power supply voltage (VDD) is supplied to the substrate of the P-MOS transistors P1 to Pn. The ground voltage (VSS) is supplied to the substrate potentials of the N-MOS transistors N1 to Nn.

A control signal generating section 1 is connected to the gates of MOS transistors P1 . . . and N-MOS transistors N1 . . . and individually controls the MOS transistors on the basis of signals C, P, R. J, T.

A plurality of ink chambers located at every third places from an end of the chamber sequence forms a first group and further, second and third groups are respectively formed in a similar way starting at the second and third places from the end. The ink-jet head includes three groups. That is, ink chambers 31, 34 . . . provided with electrodes 21, 24 constitute A group, ink chambers 32, 35 provided with electrodes 22, 25 . . . constitute B group and ink chambers 33, 36 . . . provided with electrodes 23, 26 . . . constitute C group.

Then, description will be made of operations of a drive circuit controlled by the control signal generating section 1 according to the present invention with reference to FIG. 1 to FIGS. 5A to 5D.

In an initial state, the P-MOS transistors P1 to Pn connected to the terminals D1 to Dn have been turned on and the terminals D1 to Dn are kept at the same potential (VDD) as shown in FIG. 1.

Figure 4A:
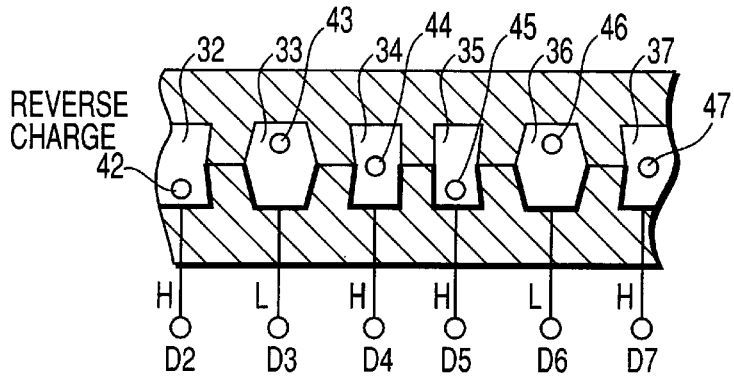
FIGS. 4A to 4D are partially sectional views by which operating conditions of ink chambers are shown when an ink-jet head according to the first embodiment is driven while being functionally divided in three ways.

A case where ink is ejected from ink jet orifices 43,46 . . . of the ink chambers 33, 36 . . . , which belong to the C group, for example, will be described. At first, as shown at a time point t1 of FIG. 5A, the P-MOS transistors P3, P6 . . . (hereinafter simply referred to as P-MOS transistor P3, as a representative, for simplicity of description) connected to the terminals D3, D6 . . . (hereinafter simply referred to as terminal D3) of the ink chambers 33, 36 (hereinafter simply referred to ink chamber 33) from which ink is desired to be ejected are turned off and then the N-MOS transistors N3, N6 . . . (hereinafter simply referred to as N-MOS transistor N3) are turned on (a reverse charge operation shown in FIG. 3A) after a time period Tp elapses in order to prevent a feed-through current from flowing. At this time, a partition wall of an piezoelectric member is distorted by a piezoelectric distortion effect in a direction of expanding the ink chambers 33, 36 . . . as shown in FIG. 4A.

Figure 4B:
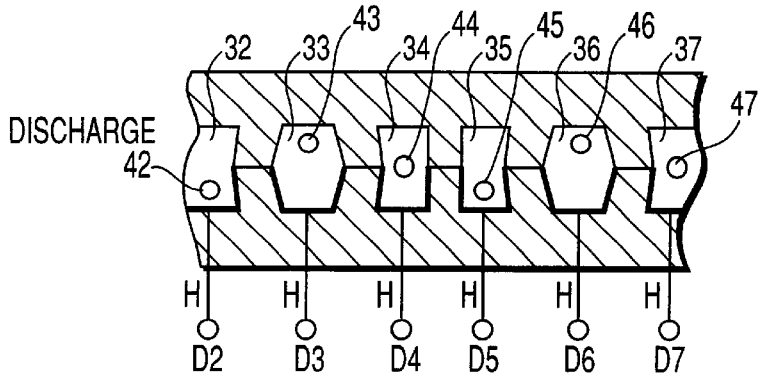
Figures 5A, 5B, 5C, 5D:
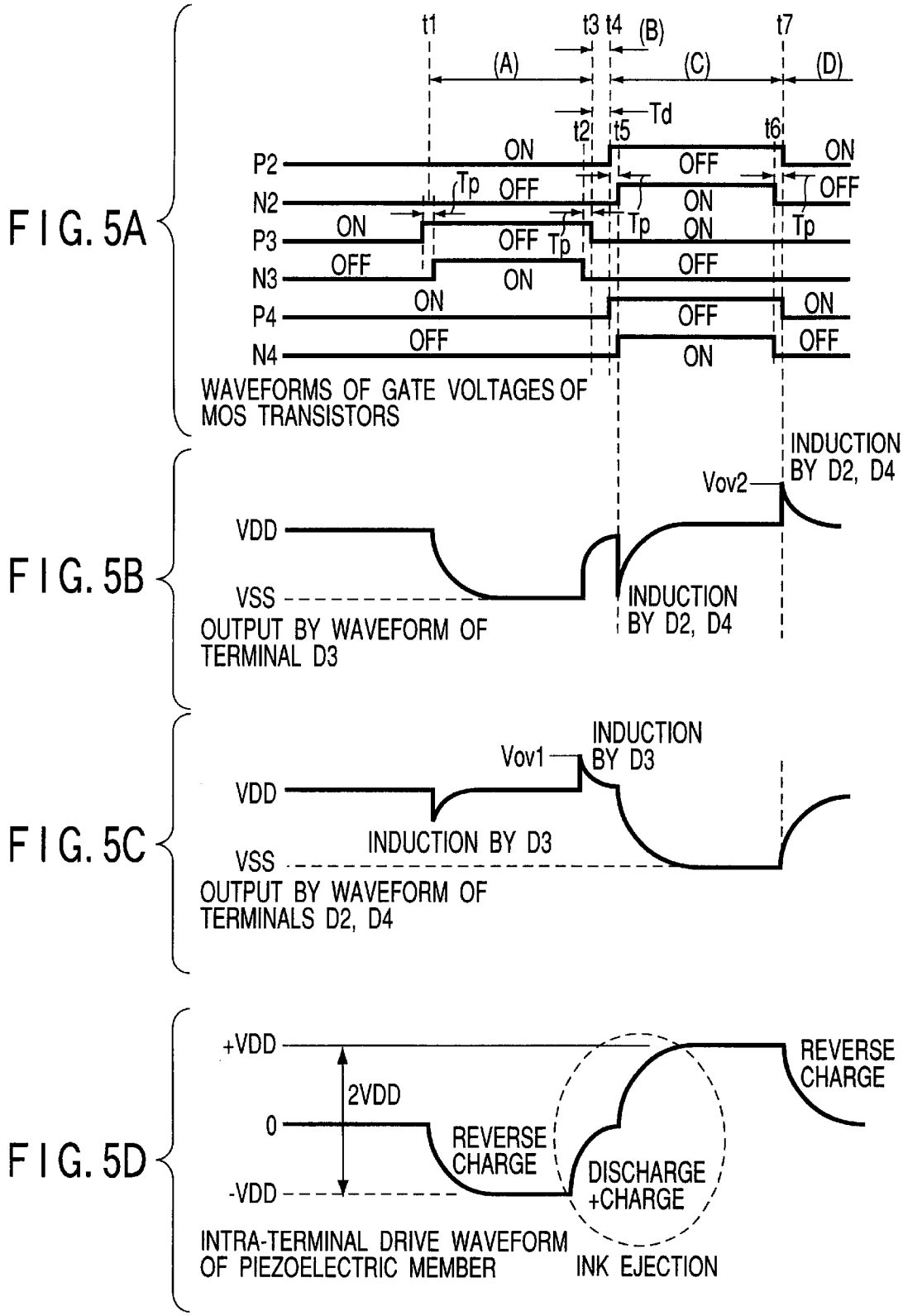
FIGS. 5A to 5D are timing charts showing operations of a drive circuit shown in FIG. 1.

Then, this state is retained for a predetermined time period and thereafter, as shown at a time point t2 of FIG. 5A, the N-MOS transistor N3 is turned off and then, the P-MOS transistor P3 is turned on after the time period Tp elapses in order to prevent a feed-through current from flowing. As a result, a potential differences between the terminal D3 and each of the terminals D2 and D4 are smaller. That is, discharge occurs from the piezoelectric members 12 and 13 (a discharge operation shown in FIG. 3B). A part of an electric charge charged into the capacitive element 12, 13 during the discharge operation of the capacitive element is discharged through a route that does not pass through a power supply of the drive circuit. In this way, since a potential difference imposed on a partition wall of a piezoelectric member is smaller, the partition wall of a piezoelectric member, as shown in FIG. 4B, is restored to an initial state shown in FIG. 2.

When the P-MOS transistor P3 is turned on, an output voltage of the terminals D2 and D4 adjacent to the terminal D3 respectively on both sides thereof goes to Vov1 which is higher than the power supply voltage (VDD) due to induction as shown at a time point t3 of FIG. 5C.

Figure 4C:
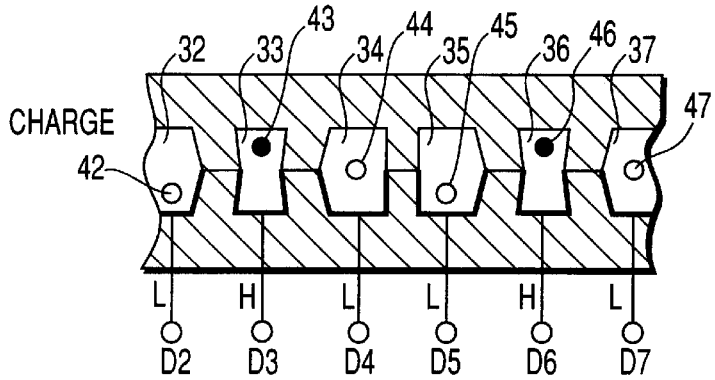
Figure 4D:
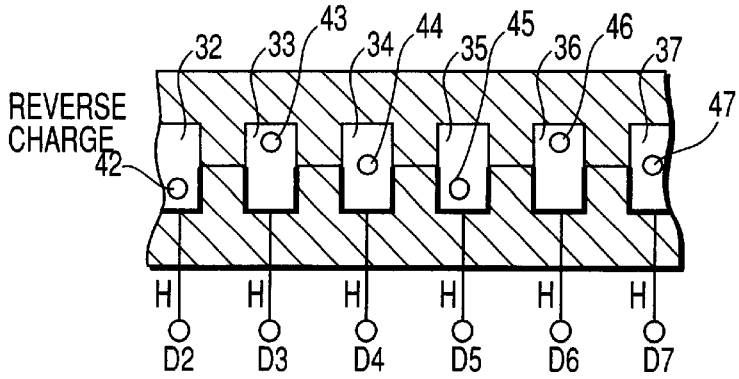

After a time period Td elapses from the time when the P-MOS transistor P3 was turned on, the P-MOS transistors P2 and P4 connected to the terminals D2 and D4 adjacent to the terminal D3 respectively on both sides thereof are turned off as shown at a time point t4 of FIG. 5A. Then, after the time period Tp in order to prevent a feed-through current from flowing, the N-MOS transistors N2 and N4 are turned on (a charge operation of FIG. 3C). At this time, the partition walls of the piezoelectric members are distorted so as to contract the ink chambers 33, 36 . . . as shown in FIG. 4C.

Such operations as reverse discharge, discharge, charge are performed at a high speed and thereby, for example, a rapid change in voltage corresponding to 2 VDD occurs in the partition wall of the piezoelectric member adjacent to the ink chamber 33 as shown in FIG. 5D. By this change ink ejection from the ink chambers 33, 36 . . . gets started.

When, the N-MOS transistors N2 and N4 adjacent to the N-MOS transistor N3 respectively on both sides thereof are turned on, an output voltage of the terminal D3 is changed by induction toward a minus direction as shown at a time point t5 of FIG. 5B. This change occurs such that the shorter a discharge time period Td is, the larger will be a deflection in a minus direction.

Figures 6A, 6B, 6C, 6D:
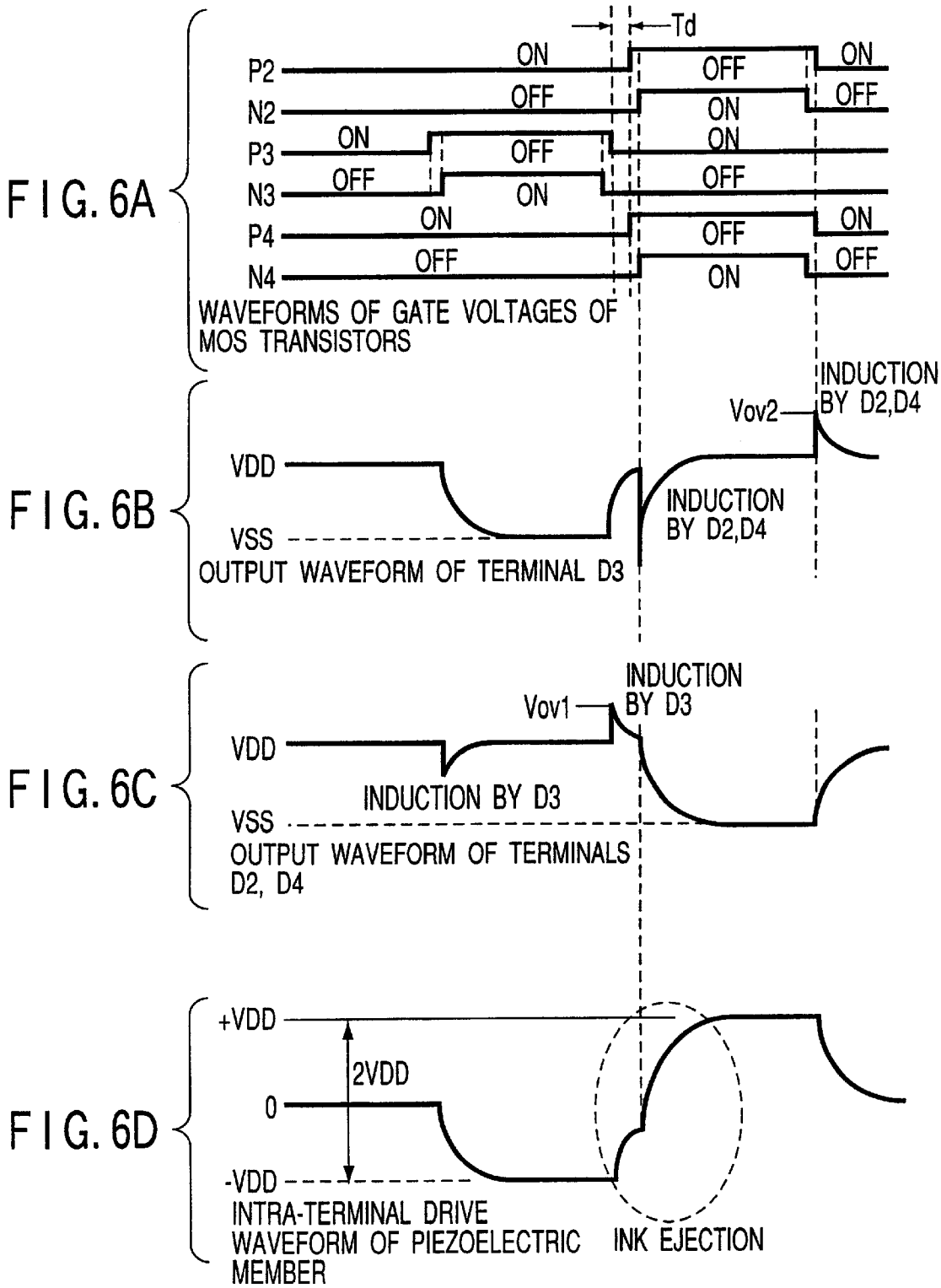
FIGS. 6A to 6D are timing charts showing operating timings in the drive circuit shown in FIG. 1 when a time period Td is short.

Therefore, in a case where a discharge time period Td is excessively short as shown in FIG. 6A and discharge cannot sufficiently be performed as shown in FIG. 6B, an output voltage of the terminal D3 is larger in deflection in a minus direction and the output voltage of the terminal D3 is eventually lower than the ground voltage (VSS).

Figure 7:
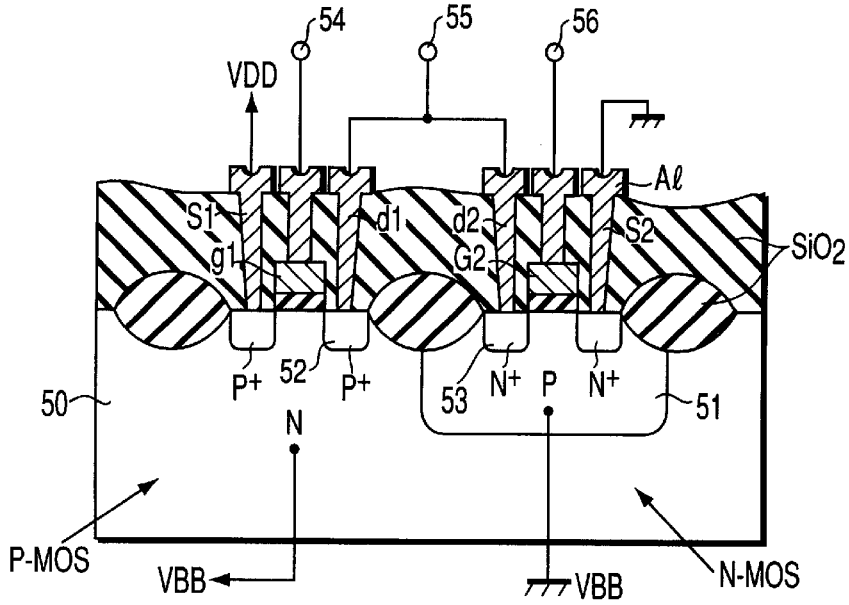
FIG. 7 is a sectional view showing a structure of a CMOS transistor.

FIG. 7 is a sectional view showing a structure of a CMOS transistor constructed of a p-channel transistor such as P1 or P2 and an n-channel transistor such as N1 or N2. The p-channel transistor includes two $P^+$ wells formed in an N substrate and a gate g1 formed on the N substrate with a silicon oxide film $SiO_2$. The gate g1 is connected to a terminal 54. The n channel transistor includes two $N^+$ wells formed in a P well and a gate g2 formed on the P well with a silicon oxide film $SiO_2$. The gate g2 is connected to a terminal 56.

As can be seen from FIG. 7, a parasitic diode is formed from the $N^+$ well and p well of N-MOS transistor connected to a terminal 55 corresponding to the terminal D3 of FIG. 1. Further, a parasitic diode is formed from the $P^+$ well of the P-MOS transistor connected to the terminal 55 and the N substrate.

As described above, when an output voltage of the terminal D3 is lower than the ground voltage (VSS), since a potential of the drain d2 of an N-MOS transistor is lower than a P substrate potential, a current flows in a parasitic diode of the N-MOS transistor. If such a phenomenon is repeated, reliability of a drive circuit itself is reduced.

On the other hand, if a discharge time period Td is longer, an output voltage of the terminal D3 is prevented from being lower than the ground voltage (VSS). However, if the discharge time period T is too longer, a rapid change in voltage between terminals of an piezoelectric member cannot be effected, whereby an ink ejecting operation is adversely affected.

Accordingly, not only is the discharge time period T is set short on condition that an output voltage of the terminal D3 is not reduced lower than the ground voltage (VSS) but the time period is determined not to be excessively long, taking an ink ejection speed and the like into consideration.

After ink ejection gets started, this state is retained for a predetermined time period as shown in FIG. 5A and thereafter, the N-MOS transistors N2 and N4 connected to the terminals D2 and D4 adjacent to the terminal D3 respectively on both sides thereof are turned off as shown at a time point t6. The P-MOS transistors P2 and P4 are turned on after the time period Tp required for prevention of a feed-through current from flowing (a reverse discharge operation shown in FIG. 3D). With this operation, the partition walls of the piezoelectric members are restored to the initial state shown in FIG. 4D and the inks in the ink chambers 33, 36 . . . are ejected from ink jet orifices 43, 46 . . . formed on orifice surfaces and fly away after separated from the ink jet orifices.

When the P-MOS transistors P2 and P4 are turned on as at a time point t7 of FIG. 5A, a voltage of the terminal D3, as shown in FIG. 5B, goes to a voltage Vov2 higher than the power supply voltage (VDD) by induction.

Accordingly, when the substrate potential of a P-MOS transistor is set to the power supply voltage (VDD), a potential of the drain d1 of the P-MOS transistor, as shown in FIG. 7, is higher than an N substrate potential and therefore, a current flows in a parasitic diode of the P-MOS transistor. Hence, if such a phenomenon is repeated, reliability of a drive circuit itself is reduced.

Therefore, in the present invention, the substrate potential (VBB) of a P-MOS transistor is set higher than Vov1 shown in FIG. 5C and Vov2 shown in FIG. 5B. Accordingly, even when output voltages of the terminals D1, D2 . . . are higher than the power supply voltage (VDD) due to induction, no current flows in a parasitic diode of the P-MOS transistor and thereby, reliability of the drive circuit can be raised.

In the embodiment, since an ink jet head is operated while being functionally divided in three ways, after the ink chambers 33, 36 . . . of the C group are driven for printing, the ink chambers 34, 37 . . . of the A group are driven for printing and thereafter, the ink chambers 32, 35 . . . of the B group are finally driven for printing as the last stage of printing of one line.

When a length of the discharge time period Td is set at a level at which an output voltage of the terminals D1, D2 . . . at least is not lower than the ground voltage (VSS), a current is prevented from flowing in a parasitic diode of an N-MOS transistor and therefore, reliability of the drive circuit can be raised.

In addition, when the substrate potential (VBB) of a P-MOS transistor is set to be higher than Vov1 shown in FIG. 5C and Vov2 shown in FIG. 5B, a current is prevented from flowing in a parasitic diode of the P-MOS transistor and therefore, reliability of the drive circuit can be raised.

Thus, according to this embodiment, low power consumption is achieved and a capacitive element drive device with high reliability can be provided by using a drive circuit in which MOS transistors are employed.

In addition, according to this embodiment, by charging and discharging a piezoelectric member, a potential difference between terminals of the piezoelectric members can assume three levels: the same potential, the power supply voltage and a negative power supply voltage. Hence, the maximum potential change of a magnitude twice as large as the power supply voltage can be obtained between terminals of the piezoelectric members.

Figure 8A:
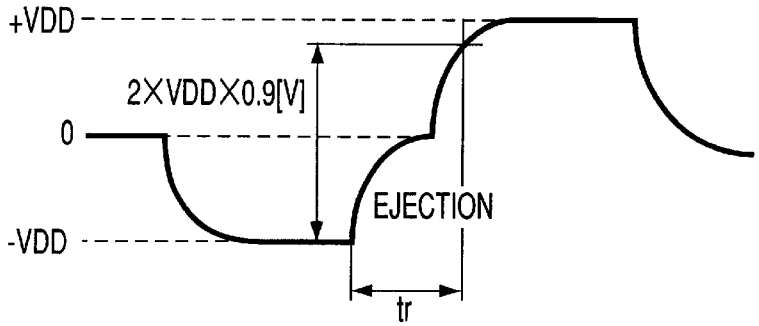
FIGS. 8A and 8B are graphs illustrating energy consumed in a drive circuit when an ink is ejected from an ink chamber.

In this embodiment, as shown in FIG. 5D, a piezoelectric element is charged after a proper discharge time period Td elapses from the time when a reverse charge is completed. FIG. 8A is a graph showing a change in intra-terminal voltage of a piezoelectric element when charge is effected after a discharge is substantially completed while taking an enough discharge time period Td.

Consumed energy of a drive circuit in this case is expressed by the following formula: $(1/2)\times C\times(VDD)^2+(1/2)\times C\times(VDD)^2=C\times(VDD)^2$.

Figure 8B:
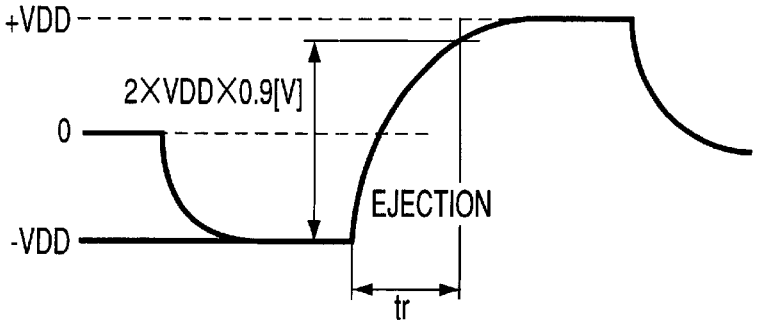

FIG. 8B shows a waveform of an intra-terminal voltage when charge is conducted without preceding discharge time period Td after reverse charge is effected. Consumed energy of the drive circuit in this case is expressed by the following formula:

$(1/2)\times C\times(2VDD)^2=2\times C\times(VDD)^2$, where a value of consumed energy corresponding to resistance in an ink jet head is neglected. That is, consumed energy of a drive circuit in the ejection of the former case is half as large as that of the latter case. Therefore, if the discharge time period Td is longer, consumed energy of a drive circuit is decreased corresponding to increase in the discharge time period Td.

In the drive circuit of this embodiment, as shown at a time point t5 of FIGS. 5A and 7B, when the P-MOS transistor P3 is turned on, the N-MOS transistors N2 and N4 adjacent to the P-MOS transistor P3 respectively on both sides thereof are turned on. Therefore, a voltage of the terminal D3 which is induced when the N-MOS transistors N2 and N4 adjacent to the p-MOS transistor P3 respectively on both sides are turned on is determined by a resistance ratio between a value of internal resistance of the P-MOS transistor p3 and a value of internal resistance of the N-MOS transistors N2 and N4 adjacent to the p-MOS transistor P3 respectively on both sides. Herein, when the internal resistance of a P-MOS transistor is large, that is a current gain (gm) is small, a voltage of the terminal D3, as shown in FIG. 6B, is apt to be equal to or lower than the ground voltage VSS. That is, a current is easy to flow into a substrate (P well) of an N-MOS transistor. This phenomenon reduces reliability of a MOS transistor circuit.

In a case of the drive circuit of this embodiment, the circuit is constructed so that a current gain (gm) of a P-MOS transistor circuit is larger than a current gain (gm) of an N-MOS transistor circuit. With such a condition, even if the discharge time period Td is short, there is no chance that an output of the terminal D3 is deflected to the minus side. As a result, since the discharge time period Td can be set shorter, the power supply voltage is raised in the ejection more early by decrease in the discharge time period. That is, by using a smaller switching device, rise characteristics of the power supply voltage required in the ink ejection can be satisfied.

Besides, when charge is conducted after a discharge of a piezoelectric member is substantially completed as shown in FIG. 8A, a large-sized MOS transistor is required in order to achieve a high speed intra-terminal voltage change required for the ink ejection. That is, a MOS-transistor whose chip size is large is required, which entails cost increase of the device.

In the present invention, as described above, the discharge time period is set short to a level at which the substrate of a MOS transistor does not assume a negative voltage. As a result, since rise and fall times are both shorter, a high speed operation can be guaranteed even with a small-sized MOS transistor in use. Accordingly, a production cost can be decreased.

It is noted that, while in this embodiment, a discharge operation is set in the time period Td, a charge operation of the capacitive element may be set in the time period Td in another embodiment of capacitive element drive sequence.

Then, description will be made of operations when ink ejection is repeatedly conducted.

The ink jet head of this embodiment is provided with piezoelectric members so that the members are aligned along a direction of polarization shown in FIGS. 9A and 9B. FIG. 9A is a waveform showing a change in a potential difference between the terminals D2 and D3 (which potential difference is the same as that between the terminals D3 and D4) and FIG. 9B shows deformation of a piezoelectric element corresponding to potential differences. In this way, when a terminal potential of a particular ink chamber to be driven is lower than terminal potentials of the ink chambers adjacent to the particular ink chamber respectively on both sides thereof, the particular ink chamber is distorted in a direction of expansion, while when higher, the particular ink chamber is distorted in a direction of contraction.

FIGS. 10A to 10C shows potential difference between terminals of ink chambers (drive waveforms). FIG. 10A is an intra-terminal voltage associated with ink chambers of the C group and as a representative example, a change in voltages between the terminals D3 and D2, and between the terminals D3 and D4. Likewise, FIG. 10B shows an intra-terminal voltage associated with the A group and FIG. 10C shows an intral-terminal voltage of the B group.

That is, at first, ink ejection from the ink chambers 33, 36 . . . (see FIG. 2) of the C group is conducted according to a drive waveform as shown in FIG. 10A, thereafter ink ejection from the ink chambers 34, 37 . . . of the A group is conducted according to a drive waveform as shown in FIG. 10B, then finally ink ejection from the ink chambers 35, 38 . . . of the B group is conducted according to a drive waveform as shown in FIG. 10C and printing of one line is thus completed. In this way, ink chambers composed of the three groups are operated in a dividing manner in three ways and, ink ejection is continuously effected with no redundant time period inserted during each of drive periods of the respective groups, thereby enabling a high speed printing.

Drive waveforms input to the respective terminals are as shown in FIGS. 10D to 10H. Herein, description will be made of a case where ink ejection from the ink chambers 33 to 36 (see FIG. 2) is repeatedly effected.

At first, in an initial state at a time point t10, all the terminals D1 to Dn (see FIG. 2) assume the power supply voltage (VDD). At a time point t11, the terminals D3, D6 are controlled so as to assume the ground voltage (VSS) and thereby, the ink chambers 33 and 36 are expanded (see FIG. 4A).

After this state is retained for a predetermined time period, potentials of the terminals D3 and D6 are raised to VDD at a time point t12 (FIG. 4B) and then, potentials of the terminals D2 and D4, and D5 and D7 adjacent to each of the terminals D3 and D6 respectively on both sides thereof are lowered to VSS (FIG. 4C). With such reduction in potential, since the ink chambers 33 and 36 are contracted from an expanded state, ink ejection gets started. In FIGS. 10D to 10H, the discharge time period Td is omitted for simplicity of description.

After this state is continued for a predetermined time period, the terminals D2 and D5 are raised to a potential VDD at a time point t13 and thereby, ink ejection from the ink chambers 33 and 36 is terminated. At the same time of the termination, a drive waveform gets started to be supplied to the terminal D4.

After this state is continued for a predetermined time period, a potential of the terminal D4 is raised to VDD at a time point t14 and then, a potential of both side terminals D3 and D5 is reduced to VSS. With the potential reduction, the ink chamber 34 is contracted from an expanded state, thereby, ink ejection getting started.

After this state is continued for a predetermined time period, potentials of the terminals D3 and D6 are adjusted to a potential VDD at a time point t15 to terminate ink ejection from the ink chamber 34 and at the same time, a drive waveform at the terminal D5 gets started.

After this state is continued for a predetermined time period, a potential of the terminal D5 is raised to VDD at a time point t16 and then, a potential of both side terminals D4 and D6 is reduced to VSS. With the potential reduction, the ink chamber 35 is contracted from an expanded state, thereby, ink ejection getting started.

After this state is continued for a predetermined time period, a potential of the terminal D4 is adjusted to a potential VDD at a time point t17 to terminate ink ejection from the ink chamber 35.

FIGS. 11A and 11B show a drive waveform of a drive circuit constructed while a direction of piezoelectric members are aligned in a reverse direction from FIGS. 9A and 9B. In this example, a terminal potential of a particular ink chamber to be driven is higher than the terminal potentials of both side ink chambers, the particular ink chamber is distorted in a direction of expansion, while when lower, the particular ink chamber is distorted in a direction of contraction. Ink is ejected from the ink chamber of the ink jet head by expanding the ink chamber once and then contracting it.

FIGS. 12A to 12C are waveforms showing a change in each of potential differences between the terminals and FIGS. 12D to 12H show waveforms input to the terminals.

In a case where piezoelectric members with such a direction of polarization are provided, a terminal voltage (for example D2) of a particular ink chamber to be driven is lowered to VSS from VDD when a terminal voltage of an adjacent ink chamber (for example, D3) is VSS, as shown in a encircled portion with a dotted line of FIGS. 12D to 12H. At this time, a terminal voltage of an adjacent ink chamber is induced to lower than VSS and as a result, a current eventually flows in a parasitic diode of an N-MOS transistor that drives the adjacent ink chamber.

Accordingly, in this embodiment, since piezoelectric members are arranged so as to assume a direction of polarization shown in FIG. 9, a terminal voltage of the particular ink chamber to be driven is never lowered to VSS from VSS when a terminal voltage of an adjacent ink chamber assumes VSS as shown in FIGS. 12A to 12H. Hence, a current is prevented from flowing in a parasitic diode of an N-MOS transistor and thereby, reliability of a drive circuit can be increased.

In the above described examples, description has been made of the case where an ink jet head in which piezoelectric members are used as capacitive elements is used and the head is driven. However, it should be noted that there is no specific limitation to the examples, but the present invention may be applied to cases where a device in which a liquid crystal member which is a capacitive element like a piezoelectric member is employed, an EL print head or the like is used and driven.

Then, description will be made of the second embodiment of a capacitive element drive device of the present invention that is applied to an ink jet head in a shared mode using piezoelectric members with reference to FIG. 13 and FIGS. 14A and 14B.

Figure 13:
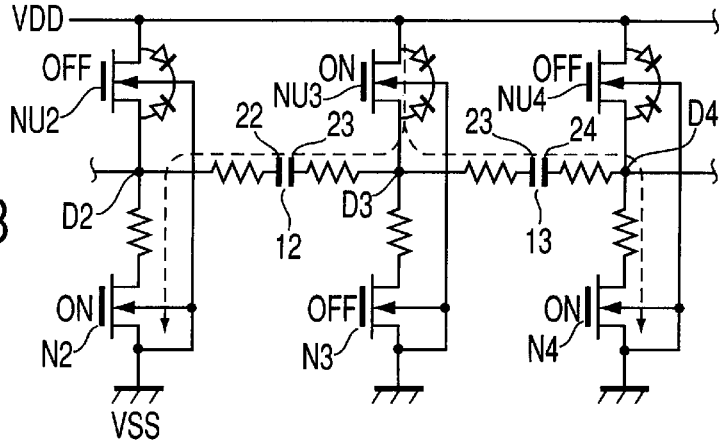
FIG. 13 is a partial circuit diagram showing a configuration of an ink-jet head drive device in a share mode according a second embodiment of the present invention.

FIG. 13 is a partial circuit diagram showing a configuration of a device according to the second embodiment. FIG. 13 is different from FIG. 1 in that switching elements on the power supply voltage (VDD) side are also constructed of N-MOS transistors and substrate potentials of all the N-MOS transistors are set to the ground voltage (VSS).

In a device according to this embodiment, the source sides of N-MOS transistors NU2 . . . on the side of the power supply voltage (VDD) are respectively connected to capacitive loads and therefore, when the N-MOS transistors NU2 . . . are turned on to charge the capacitive loads, the source potentials are raised and finally reach the power supply voltage (VDD).

Figure 14A:
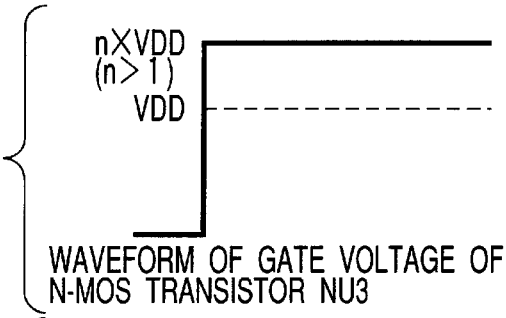
FIGS. 14A and 14B are graphs respectively showing waveforms of a gate voltage and a source voltage of an N-MOS transistor of the drive circuit shown in FIG. 13.
Figure 14B:
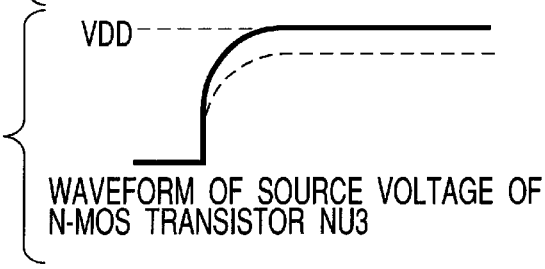

However, if gate voltages of N-MOS transistors NU2 . . . are set to the same as the power supply voltage (VDD) as shown with a dotted line of FIG. 14A, as the source voltages are raised, sufficient current gains (gm) cannot be attained due to a back gate effect (a substrate bias effect). As a result, the source voltages cannot sufficiently be charged so as to reach the power supply voltage (VDD) as shown with a dotted line of FIG. 14B.

For this reason, in this embodiment, the gate voltage is sufficiently higher than the power supply voltage (VDD) as shown with a solid line of FIG. 14A. Therefore, even when the N-MOS transistors NU1 to NU2 on the side of the power supply voltage are turned on, the source voltage can be charged up to the power supply voltage (VDD) as shown with a solid line of FIG. 14B.

In this embodiment with such a constitution as this as well, the MOS transistors are controlled and ink is ejected as in the case of FIG. 5A. Besides, in the second embodiment as well, similar to the first embodiment, a current is prevented from flowing in parasitic diodes of the N-MOS transistors. Furthermore, when the N-MOS transistors NU1 to NU2 on the side of the power supply voltage are turned on, the source voltages thereof can be charged up to the power supply voltage (VDD) for sure. Accordingly, there can be provided a capacitive element drive device which is low in power consumption, high in reliability at a lower cost.

Then, description will be made of the third embodiment of a capacitive element drive device of the present invention that is applied to an ink jet head of an independent type using piezoelectric members with reference to FIG. 15 to FIGS. 17A to 17E.

Figure 15:
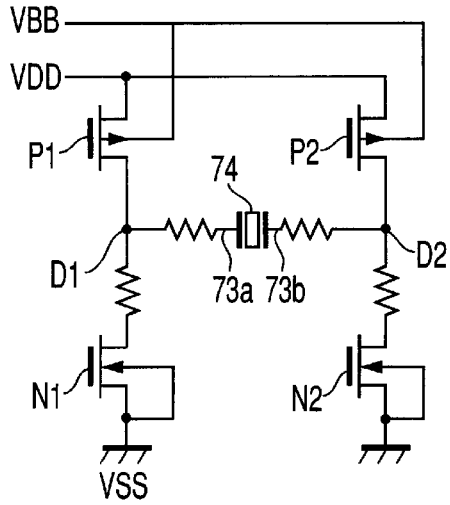
FIG. 15 is a partial circuit diagram showing a configuration of a ink-jet head drive device of a Kayser type according to a third embodiment of the present invention.

FIG. 15 is a partial circuit diagram showing a configuration of the third embodiment and FIGS. 16A to 16D are partially sectional views showing a structure of an ink jet head of a Kayser type which is an independent type. In the ink jet head of a Kayser type, an upper plate of an ink chamber 41 is composed of an elastic plate 72 and an piezoelectric member 74 both side surfaces of which are composed of electrodes 73 is provided on a top surface of an upper plate 72. When an ink chamber 71 is expanded by swelling the elastic plate 72 so as to be convex toward above with the help of the piezoelectric member 74, ink 76 is sucked through an ink supply port 75. Then, when the elastic plate 72 is vigorously deformed downwardly so as to convex toward under and the ink chamber 71 is contracted, the ink is ejected from an ink jet orifice 76.

Such an ink jet head drive circuit is constructed so that four switching elements are provided to one piezoelectric member 74 for driving one ink chamber 71. Concretely, as shown in FIG. 15, a P-MOS transistor P1 is connected between a terminal D1 connected to one electrode 73*a* of the piezoelectric member 74 by way of an internal resistance, and the power supply voltage (VDD). An N-MOS transistor N1 is connected between the terminal D1 and the ground voltage (VSS). A P-MOS transistor P2 is connected between a terminal D2 connected to the other electrode 73*b* of the piezoelectric member 74 by way of an internal resistance, and the power supply voltage (VDD). An N-MOS transistor N2 is connected between the terminal D2 and the ground voltage (VSS). A substrate potential of the P-MOS transistors P1 and P2 are set to VBB and a substrate potential of the N-MOS transistors N1 and N2 is set to the ground voltage (VSS).

Description will be made of operations in such a drive circuit with reference to FIGS. 16A to 16D and FIGS. 17A to 17E. In an initial state, the P-MOS transistors P1 to Pn connected to the respective terminals D1 to Dn are turned on and the terminals D1 to Dn are retained at the same potential (VDD).

Figure 17A:
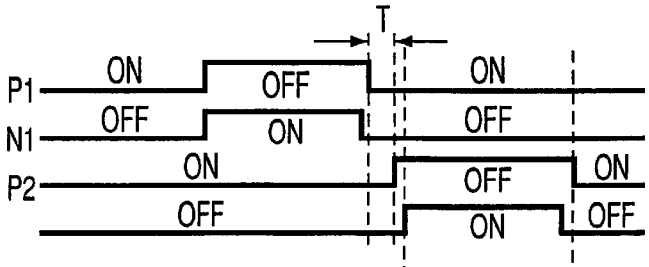
FIGS. 17A to 17E are timing charts showing operations of the drive circuit shown in FIG. 15.

In a case where ink is ejected from a particular ink chamber 71, at first, the P-MOS transistor P1 connected to the terminal D1 of the ink chamber 71 from which the ink is ejected out is turned off as shown in FIG. 17A. Then, the N-MOS transistor N1 is turned on after a time period Tp to prevent a feed-through current from flowing elapses (a reverse charge operation shown in FIG. 16B). At this time, the piezoelectric member 74 is distorted in a direction of expanding the ink chamber 71.

Then, as shown in FIG. 17A, this state is retained for a predetermined time period and further, the N-MOS transistor N1 is turned off. Then, the P-MOS transistor P1 is turned on after the time Tp to prevent a feed-through current from flowing elapses and thereby, a potential difference between the terminals D1 and D2 is made smaller (a discharge operation including discharge+charge shown in FIG. 16C). At this time, since a potential difference imposed to the piezoelectric member 74 is diminished, the piezoelectric element 74 is restored to its initial state shown in FIG. 16A.

When the P-MOS transistor P1 is turned on, an output voltage of the terminal D2 on the other side is raised to Vov1 higher than the power supply voltage (VDD) by induction.

Figure 16A:
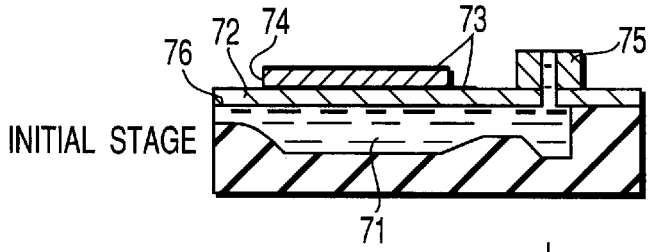
FIGS. 16A to 16D are sectional views showing operating states of ink chambers when an ink-jet head of a Kayser type according to the third embodiment is driven.
Figure 16B:
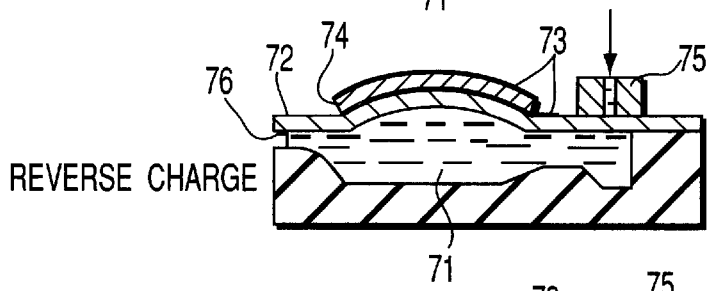
Figure 16C:
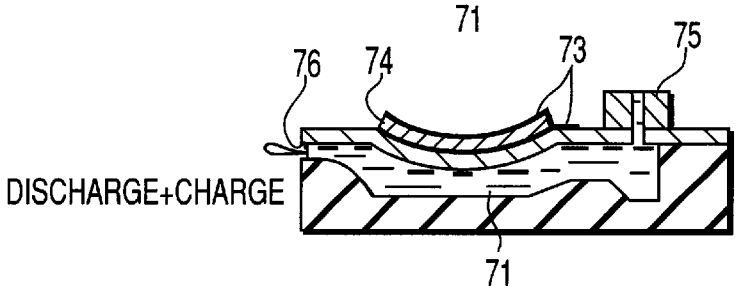
Figure 16D:
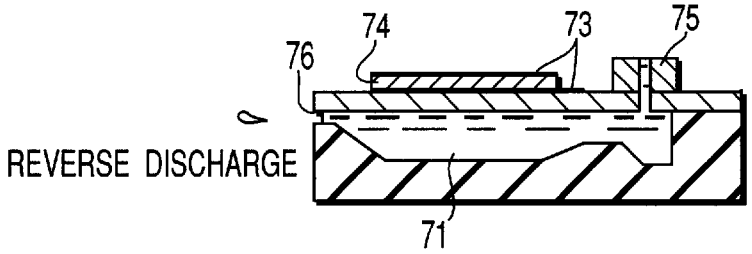

After a time Td during which the P-MOS transistor P1 is kept in the on state elapses, the P-MOS transistor P2 connected to the terminal D2 on the other side is turned off as shown in FIG. 17A. Then, the N-MOS transistor N2 is turned on after a time to prevent a feed-through current from flowing elapses (a charge operation including discharge+charge shown in FIG. 16C). At this time, the piezoelectric member 74 is distorted in a direction of contracting the ink chamber 71 as shown in FIG. 16C.

Figure 17B:
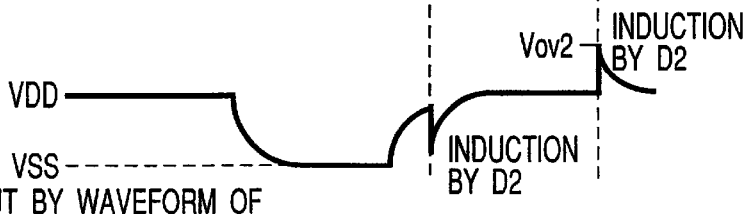
Figure 17C:
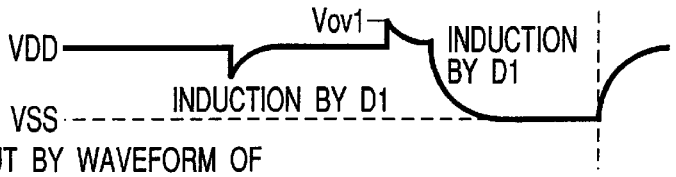
Figure 17D:
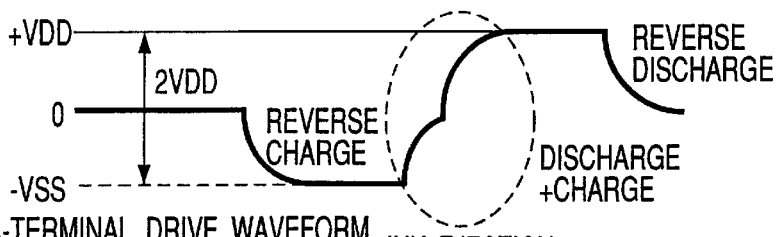

By conducting such series of operations of reverse discharge, discharge and charge at a high speed, a rapid change in intra-terminal voltage corresponding to 2 VDD occurs in the piezoelectric member 74 as shown in FIG. 17D. With this rapid change, the ink is started being ejected from the ink chamber 71.

When the N-MOS transistor N2 connected to the electrode of the other side is turned on, an output voltage of the terminal D1 is changed in a minus direction by induction as shown in FIG. 17B. This change is lager in deflection in the minus direction as the discharge time period Td is shorter.

When a sufficient discharge cannot be performed since the discharge time period is excessively short, a problem similar to the first embodiment occurs. That is, the output voltage of the terminal D1 is deflected larger in the minus direction and the output voltage of the terminal D1 becomes lower than the ground voltage (VSS). In this situation, a potential of the drain of the N-MOS transistor is lower than a substrate potential and therefore, a current is eventually made to be flowed in a parasitic diode of the N-MOS transistor. If this phenomenon is repeated, reliability of the drive circuit itself is deteriorated.

While if the discharge time period Td is longer, an output voltage of the terminal D1 is prevented from being decreased to be lower than the ground voltage (VSS), if the discharge time period Td is too long, a voltage between terminals of piezoelectric member cannot rapidly be changed, which affects an ink ejection operation adversely.

Accordingly, in this embodiments as well, similar to the first embodiment, not only is the discharge time period Td is set short on condition that an output voltage of the terminal D1 is not reduced lower than the ground voltage (VSS) but the time period is determined not to be excessively long, taking an ink ejection speed and the like into consideration.

Then, after ink starts ejection, this state is retained for a predetermined time period and then the N-MOS transistor N2 connected to the terminal D2 of the other side is turned off as shown in FIG. 17A. Following this, the P-MOS transistor P2 is turned off after the time Tp to prevent a feed-through current from flowing elapses (a reverse discharge operation shown in FIG. 16D). With this operation performed, the piezoelectric member 74 is restored to its initial state and the ink is ejected from the ink jet orifice formed on the orifice surface and flown away.

When the P-MOS transistor P2 is turned on, a voltage of the terminal D1 is raised to Vov2 higher than the power supply voltage (VDD) by induction. Therefore, if a substrate potential of a P-MOS transistor is set to the power supply voltage (VDD), a potential of the drain of the P-MOS transistor becomes higher than the substrate potential and therefore, a current flows in a parasitic diode of the P-MOS transistor. Hence, if this phenomenon is repeated, reliability of the drive circuit itself is reduced.

Taking the situation into consideration, in the present invention, similar to the first embodiment, a substrate potential (VBB) of a P-MOS transistor is set higher than Vov1 shown in FIG. 17C and Vov2 shown in FIG. 17B. With such a higher substrate potential, even when an output voltage of the terminal D1 is raised higher than the power supply voltage (VDD) under influence of induction, a current does not flow in a parasitic diode of a P-MOS transistor, whereby reliability of the drive circuit can be increased.

In this way, if a constitution of this embodiment is adopted, even in a drive circuit for driving an ink jet head of a Kayser type, an effect similar to that of the first embodiment can exerted.

Figure 17E:
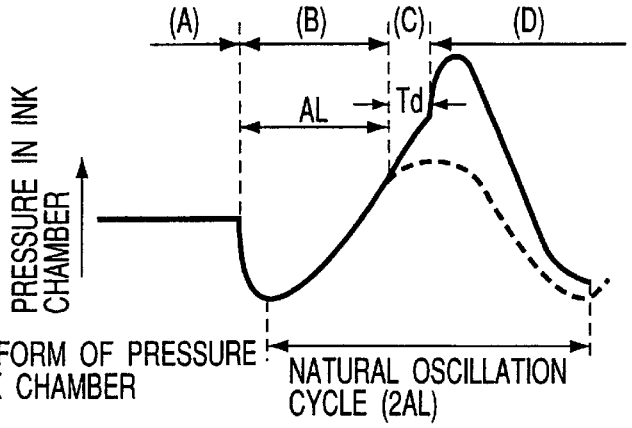

Now, description will be made of an concrete example in a case where a proper value of the discharge time period Td in this embodiment is determined with reference to FIG. 17E. FIG. 17E shows a waveform of an ink chamber pressure, especially an ink pressure in the vicinity of an orifice.

When an ink chamber 71 as shown in FIGS. 16A to 16D is driven, a voltage is at first applied to the piezoelectric member 74 so that the ink chamber 71 is expanded (B: a reverse charge operation). At this time, a pressure in the ink chamber 71 is rapidly reduced to be minus. In this situation, if the drive waveform is continued to be in the state, a pressure in the ink chamber 71 oscillates at dominant acoustic resonance frequency (a cycle: 2 AL sec) that is determined by a length of the ink chamber 71, a riditity of the ink chamber 71, a sonic velocity in the ink and the like (a waveform shown with a dotted line of FIG. 17E).

Therefore, a drive waveform is adopted such that after a reverse discharge gets started and further, a time period AL (sec) which is a half of a cycle of the dominant acoustic resonance frequency elapses, discharge and charge operations are conducted at a high speed and a pressure in the ink chamber is rapidly raised to eject the ink (C: discharge+charge operation).

In this way, the ink is ejected by utilizing natural oscillation of the ink chamber 71. In this case, if the discharge time period is set long so as to establish a relationship Td>AL/2 a pressure in the ink chamber 71 is increased due to the discharge operation and thereafter a pressure in the ink chamber 71 is reduced, so that a good ink ejection performance cannot be attain. Accordingly, the discharge time period Td may be set to a time period equal to or less than ¼ as long as the cycle of the dominant acoustic resonance frequency (2 AL sec). Since an adjacent charge operation is started before a pressure is reduced after a discharge operation is terminated, a pressure in the ink chamber 71 is rapidly increased like a solid waveform shown in FIG. 17E, so that a good ink ejection performance can be achieved.

Then, description will be made of the fourth embodiment in which the present invention is applied to a drive device by which a liquid crystal member that is adopted in a liquid crystal display is driven with reference to FIG. 18 and FIGS. 19A to 19F.

Figure 18:
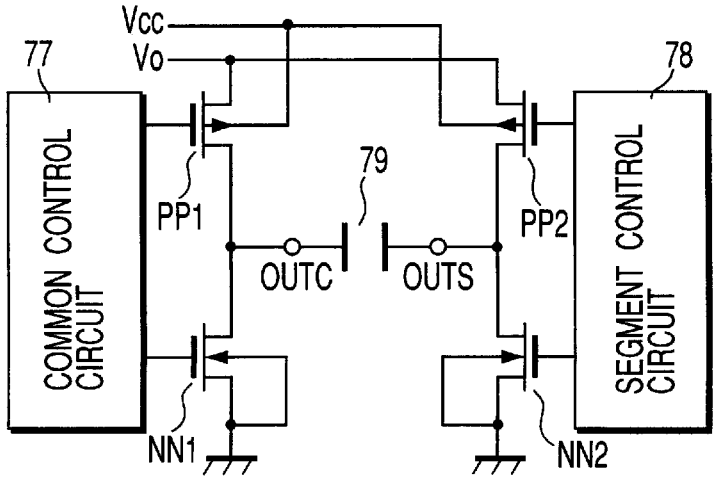
FIG. 18 is a partial circuit diagram showing a configuration of a drive device for a liquid crystal member according to a fourth embodiment of the present invention.

FIG. 18 is a partial circuit showing a configuration of a device according to this embodiment and a numerical mark 71 is a liquid crystal member as a capacitive element. One electrode of the liquid crystal member 71 is indicated by OUTC and the other electrode is indicated by OUTS. A P-MOS transistor PP1 is connected between the electrode OUTC and the power supply voltage (V0) and an N-MOS transistor NN1 is connected between the electrode OUTC and the ground voltage (VSS). A P-MOS transistor PP2 is connected between the electrode OUTS and the power supply voltage (V0) and an N-MOS transistor NN2 is connected between the electrode OUTS and the ground voltage (VSS).

A substrate potential of the P-MOS transistors PP1 and PP2 are set to VCC and a substrate potential of the N-MOS transistors NN1 and NN2 are set to the ground voltage (VSS). Besides, the gates of the P-MOS transistor PP1 and the N-MOS transistor NN1 are applied with a control voltage from a common control circuit 77. The gates of the P-MOS transistor PP2 and the N-MOS transistor NN2 are applied with a control voltage from a segment control circuit 73.

The drive circuit is driven by a static drive method. The static drive method is a control method in which a liquid crystal member is controlled by applying a voltage between a segment electrode on which a display is shown and a common electrode during a time period as long as a display is desired to be shown.

When a liquid crystal display array with a plurality of cells arranged, in each cell a liquid crystal member being disposed, is driven by DC, a problem arises since an electrochemical reaction is invoked in the interior of each of the liquid crystal cells and therefore, a lifetime of a liquid crystal display is greatly shortened.

Figures 19A, 19B, 19C, 19D, 19E, 19F:
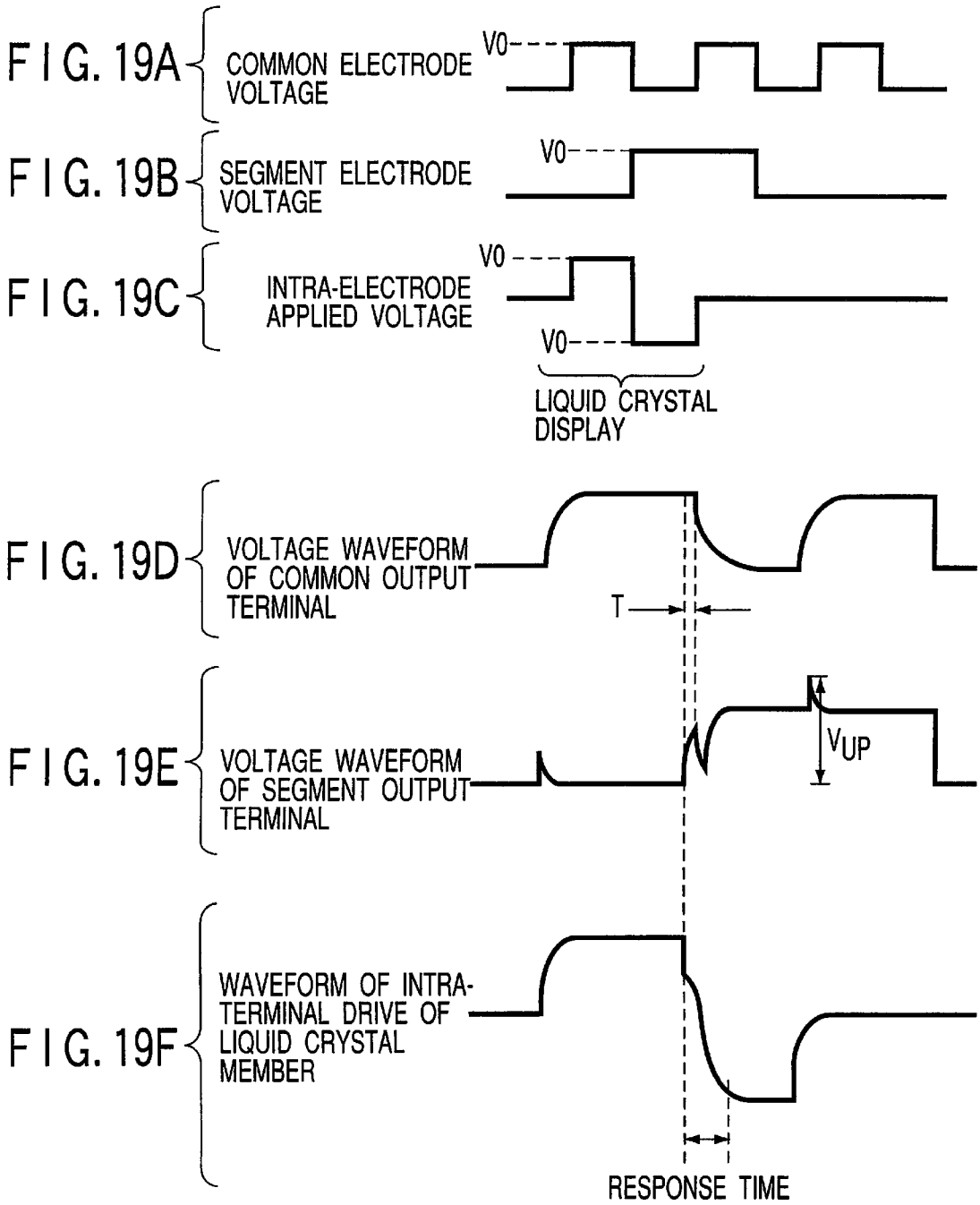
FIGS. 19A to 19F are timing charts showing operations of the drive circuit shown in FIG. 18.
Figure 20:
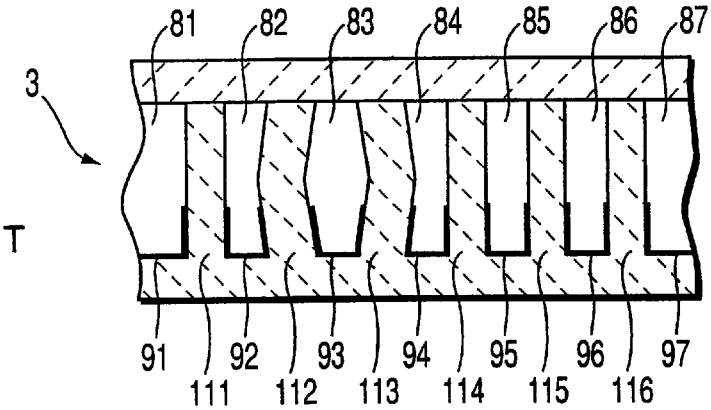
FIG. 20 PRIOR ART
FIG. 20 is a partially sectional view illustrating a structure of a conventional ink-jet head.
Figure 21:
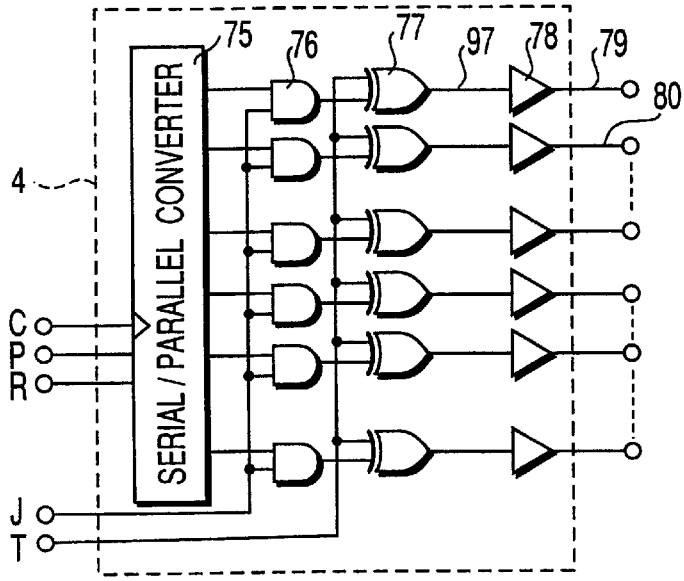
FIG. 21 PRIOR ART
FIG. 21 is a circuit diagram showing a configuration of a conventional ink-jet head drive device.
Figure 22:
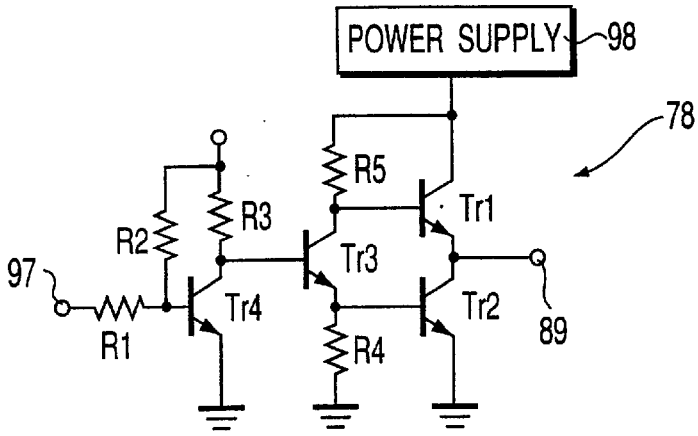
FIG. 22 PRIOR ART
FIG. 22 is a circuit diagram showing a configuration of part of a drive circuit shown in FIG. 21.

For this reason, a square wave voltage of a peak value V0 whose phase is shifted by $\pi/2$, as shown in FIGS. 19A and 19B, is applied to the segment electrode and common electrode as a gate voltage. In this case, an applied voltage to the liquid crystal member changes by 2V0 (−V0 to V0) as shown in FIG. 19C. Since an average applied voltage on the liquid crystal 71 is 0V, degradation of a liquid crystal is prevented from occurring.

Voltage waveforms of the common output terminal (OUTC) and the segment output terminal (OUTS) are respectively shown in FIGS. 19D and 19E. Besides, an intra-terminal drive waveform of the liquid crystal member 71 is shown in FIG. 19F.

Here, description will be made of a concrete example of a case where a proper value of the discharge time period Td of this embodiment is determined with reference to FIG. 19F.

If a rise time and a fall time of a drive waveform shown in FIG. 19F are longer than a response time of a liquid crystal, liquid crystal display characteristics are deteriorated. Hence, the rise and fall times are desired to be equal to or less than the response time.

The discharge time period Td of a drive device for a liquid crystal member may be set to a time period equal to or less than ½ times as long as a response time. Concretely, a time period in which the applied voltage is changed from the −V0 side to the +V0 side may be equal to or less than a response time. In this way, by setting the discharge time period to a proper value, good liquid crystal display characteristics and increased reliability of a drive circuit can also be attained when a liquid crystal member is driven.

In this embodiment as well, similar to the first embodiment, a substrate potential (VCC) of a P-MOS transistor is set higher than Vup shown in FIG. 19E. Therefore, even when a voltage of the drain of a P-MOS transistor is raised higher than the power supply voltage (V0) under an influence of induction, a current does not flow in a parasitic diode and reliability of the drive circuit can be increased.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A capacitive element drive device for driving a capacitive element by supplying a first potential difference between first and second terminals of the capacitive element and thereafter, supplying a second potential difference of a polarity opposite from the first potential difference, wherein a delay time is set in a time period from a change-start time when a potential of the first terminal of the capacitive element is changed from a first potential to a second potential to a change-start time when a potential of the second terminal is changed from the second potential to the first potential and the delay time is less than a time period in which the change of potentials from the first potential to the second potential of the first terminal is substantially completed and at least equal to a predetermined time interval which is greater than 0.

2. A capacitive element drive device according to claim 1, wherein part of an electric charge provided to the capacitive element during the delay time is discharged through a route that does not pass through a power supply of the drive device.

3. A capacitive element drive device according to claim 1, wherein the drive device includes a plurality of drive circuits for driving the terminals of the capacitive element, each of the drive circuits comprising:

an output terminal connected to one of the first and second terminals of the capacitive element;

a first switching element having a first current terminal to which a first power supply voltage is supplied, a second current terminal connected to the output terminal and a control terminal to which a first control signal is input; and a second switching element having a first current terminal connected to the output terminal, a second current terminal coupled to a ground potential and a control terminal to which a second control signal is input.

4. A capacitive element drive device according to claim 3, wherein the first switching element is a P-MOS transistor and the second switching element is an N-MOS transistor.

5. A capacitive element drive device according to claim 1, wherein the drive device includes a plurality of drive circuits for driving the terminals of the capacitive element, each of the drive circuits comprising:

an output terminal connected to one of the first and second terminals of the capacitive element;

a first switching element having a first current terminal to which a first power supply voltage is supplied, a second current terminal connected to the output terminal and a control terminal to which a first control signal is input, a substrate being supplied with a second power supply voltage; and a second switching element having a first current terminal connected to the output terminal, a second current terminal coupled to a ground potential and a control terminal to which a second control signal is input, a substrate being supplied with a ground potential.

6. A capacitive element drive device according to claim 5, wherein the predetermined time interval is a time interval at which a potential of the first terminal of the capacitive element to be driven is reduced to the ground potential by induction when the potential of the second terminal is changed from the second potential to the first potential.

7. A capacitive element drive device according to claim 5, wherein the first switching element is a P-MOS transistor and the second switching element is an N-MOS transistor.

8. A capacitive element drive device according to claim 5, wherein a current gain of the first switching element is larger than a current gain of the second switching element.

9. A capacitive element drive device according to claim 3, wherein the first and second switching elements are N-MOS transistors, and the substrates of the N-MOS transistors are supplied with a ground potential and potentials of the first and second control signals have a potential higher than a potential of the power supply voltage.

10. A capacitive element drive device according to claim 9, wherein a current gain of the first switching element is larger than a current gain of the second switching element.

11. A capacitive element drive device with capacitive loads including a plurality of capacitive elements for driving the capacitive element by supplying a first potential difference between first and second terminals of the capacitive element and thereafter, supplying a second potential difference of a polarity opposite from the first potential difference, wherein a delay time is set in a time period from a change-start time when a potential of the first terminal of the capacitive element is changed from a first potential to a second potential to a change-start time when a potential of the second terminal is changed from the second potential to the first potential and the delay time is less than a time period in which the change of potentials from the first to second potential of the first terminal is substantially completed and at least equal to a predetermined time interval which is greater than 0.

12. A capacitive element drive device according to claim 11, wherein the capacitive element has a piezoelectric member and the capacitive load is an ink jet head from which ink is ejected by a piezoelectric distortion effect, and the delay time is set to a time interval equal to or less than ¼ times as long as a cycle of a dominant acoustic resonance frequency of the ink jet head.

13. A capacitive element drive device according to claim 11, wherein the capacitive element has liquid crystal member and the delay time is set to a time interval equal to or less than ½ times as long as a response time of the liquid crystal member.

14. A capacitives element drive device according to claim 11, wherein the drive device includes a plurality of drive circuits for driving the terminals of the capacitive element, each of the drive circuits comprising:

an output terminal connected to one of the first and second terminals of the capacitive element;

a first switching element having a first current terminal to which a first power supply voltage is supplied, a second current terminal connected to the output terminal and a control terminal to which a first control signal is input, a substrate being supplied with a second power supply voltage; and a second switching element having a first current terminal connected to the output terminal, a second current terminal grounded and a control terminal to which a second control signal is input, a substrate being supplied with a ground potential.

15. A capacitive element drive device according to claim 14, wherein the first switching element is a P-MOS transistor and the second switching element is an N-MOS transistor.

16. A capacitive element drive device according to claim 14, wherein the predetermined time interval is a time interval at which a potential of a terminal of the capacitive element to be driven is reduced to the ground potential by induction when the potential of the second terminal is changed from the second potential to a first potential.

17. A drive method for a capacitive element of a capacitive element drive device for driving the capacitive element by supplying a first potential difference between first and second terminals of the capacitive element and thereafter supplying a second potential difference whose polarity is opposite to the first potential difference, the method comprising the steps of:

driving the first terminal of the capacitive element to a first potential;

driving the first terminal from the first potential to a second potential;

driving the second terminal from the second potential to the first potential after a predetermined delay time has elapsed from a driving-start time when the first terminal is driven from the first potential to the second potential, wherein the predetermined delay time is set to less than a time period in which the change of potentials from the first to second potential of the first terminal is substantially completed and more than or equal to a predetermined time interval which is greater than 0.

18. A driving method for a capacitive element according to claim 17, wherein the predetermined time interval is a time interval at which a potential of a first terminal of the capacitive element to be driven is reduced to the ground potential by induction when the potential of the second terminal is changed from the second potential to a first potential.

* * * * *